US011501715B2

(12) United States Patent
Jo et al.

(10) Patent No.: US 11,501,715 B2
(45) Date of Patent: Nov. 15, 2022

(54) DISPLAY DEVICE INCLUDING SCAN DRIVER

(71) Applicant: SAMSUNG DISPLAY CO., LTD., Yongin-si (KR)

(72) Inventors: Kang Moon Jo, Hwaseong-si (KR); Chong Chul Chai, Seoul (KR); Young Wan Seo, Suwon-si (KR); Cheol-Gon Lee, Suwon-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/908,903

(22) Filed: Jun. 23, 2020

(65) Prior Publication Data

US 2021/0056909 A1 Feb. 25, 2021

(30) Foreign Application Priority Data

Aug. 19, 2019 (KR) ..... 10-2019-0101156

(51) Int. Cl.
*G09G 3/3266* (2016.01)
*G09G 3/20* (2006.01)
*G09G 3/3258* (2016.01)

(52) U.S. Cl.
CPC ..... *G09G 3/3266* (2013.01); *G09G 3/2003* (2013.01); *G09G 3/3258* (2013.01); *G09G 2310/06* (2013.01); *G09G 2310/08* (2013.01)

(58) Field of Classification Search
CPC .. G09G 3/3266; G09G 3/2003; G09G 3/3258; G09G 2310/06; G09G 2310/08; G09G 2310/0286
See application file for complete search history.

(56) References Cited

U.S. PATENT DOCUMENTS

| | | | | |
|---|---|---|---|---|
| 10,102,803 | B2 | 10/2018 | Park et al. | |
| 2004/0227718 | A1* | 11/2004 | Park | G11C 19/184 345/100 |
| 2008/0191980 | A1* | 8/2008 | Jeon | G09G 3/3677 345/87 |
| 2012/0133626 | A1* | 5/2012 | Chung | G09G 3/3648 345/208 |
| 2013/0106920 | A1* | 5/2013 | Park | G09G 3/3677 345/690 |

(Continued)

FOREIGN PATENT DOCUMENTS

| | | |
|---|---|---|
| KR | 10-0799313 | 1/2008 |
| KR | 10-2015-0065572 | 6/2015 |

(Continued)

*Primary Examiner* — Kenneth Bukowski

(74) *Attorney, Agent, or Firm* — F. Chau & Associates, LLC

(57) ABSTRACT

A display device includes a substrate that includes a display area for displaying an image and a non-display area surrounding the display area, a plurality of pixels that are disposed in the display area and each include an organic light emitting diode and a pixel circuit portion configured to operate the organic light emitting diode, and a scan driver that is disposed in the non-display area and includes a plurality of stages configured to output scan signals to the plurality of pixels. The plurality of stages may be arranged in n columns, a height of one stage may correspond to a height of n pixels, and n may be an integer of 2 or more.

23 Claims, 15 Drawing Sheets

(56) References Cited

U.S. PATENT DOCUMENTS

| | | | | |
|---|---|---|---|---|
| 2015/0356909 | A1* | 12/2015 | Lim | G09G 3/3677<br>345/205 |
| 2016/0351160 | A1* | 12/2016 | In | G09G 3/3225 |
| 2019/0019462 | A1* | 1/2019 | Kim | G09G 3/3677 |

FOREIGN PATENT DOCUMENTS

| | | |
|---|---|---|
| KR | 10-2015-0066981 | 6/2015 |
| KR | 10-2017-0114026 | 10/2017 |

* cited by examiner

DISPLAY DEVICE INCLUDING SCAN DRIVER

CROSS-REFERENCE TO RELATED APPLICATION

This application claims priority under 35 U.S.C. § 119 to Korean Patent Application No. 10-2019-0101156, filed in the Korean Intellectual Property Office on Aug. 19, 2019, the disclosure of which is incorporated by reference herein in its entirety.

TECHNICAL FIELD

Exemplary embodiments of the inventive concept relate to a display device, and more particularly, to a display device including a scan driver.

DISCUSSION OF RELATED ART

An organic light emitting diode display device is a type of device for displaying an image. Since the organic light emitting diode display device has a self-emission characteristic and does not require an additional light source, unlike a liquid crystal display device, it is possible to reduce thickness and weight thereof. Furthermore, the organic light emitting diode display device has high-quality characteristics such as low power consumption, high luminance, and high response speed.

Generally, the organic light emitting diode display device includes a substrate, a plurality of thin film transistors disposed on the substrate, a plurality of insulating layers disposed between lines for configuring the thin film transistors, and an organic light emitting diode (OLED) connected to the thin film transistors. Particularly, an additional thin film transistor is used to allow the OLED to operate to emit light.

As demand for high-resolution display devices increases, an area occupied by a pixel including the plurality of thin film transistors and the OLED decreases.

SUMMARY

According to an exemplary embodiment of the inventive concept, a display device includes a substrate that includes a display area for displaying an image and a non-display area surrounding the display area, a plurality of pixels that are disposed in the display area and each include an organic light emitting diode and a pixel circuit portion configured to operate the organic light emitting diode, and a scan driver that is disposed in the non-display area and includes a plurality of stages configured to output scan signals to the plurality of pixels. The plurality of stages may be arranged in n columns, a height of one stage may correspond to a height of n pixels, and n may be an integer of 2 or more.

The substrate may further include lines that are disposed in the non-display area and configured to apply a control signal including a clock signal, and lines configured to apply a voltage used in the scan driver, and one of the lines configured to apply the control signal including the clock signal or one of the lines configured to apply the voltage used in the scan driver may cross at least one of the plurality of stages.

The lines configured to apply the control signal including the clock signal may include four clock lines and a global clock signal line, and the lines configured to apply the voltage used in the scan driver may include a low voltage line.

The global clock signal line or the low voltage line may cross the at least one of the plurality of stages.

The four clock lines, the global clock signal line, and the low voltage line may be formed in each of the plurality of stages.

The four clock lines may be disposed farthest from the display area at an outer edge of the non-display area or between adjacent columns of the n columns.

The display device may further include a signal controller configured to provide a clock signal, a global clock signal, and a low voltage to the four clock lines, the global clock signal line, and the low voltage line, respectively.

The display device may further include a test line configured to test a display device and disposed on the substrate, and a driving low voltage line configured to apply a driving low voltage to the plurality of pixels. The test line and the driving low voltage line may be disposed farther from the display area than the four clock lines.

Each of the plurality of stages may include three clock input terminals, a global clock signal input terminal, a low voltage input terminal, a start signal input terminal, and an output terminal.

Each of the plurality of stages may be connected to three of the four clock lines. A first stage of a first column disposed in a first row may be connected to a first clock line, a second clock line, and a third clock line. A second stage of a second column disposed in the first row may be connected to the second clock line, the third clock line, and a fourth clock line. A third stage of a third column disposed in the first row may be connected to the third clock line, the fourth clock line, and the first clock line. A fourth stage of the first column disposed in a second row may be connected to the fourth clock line, the first clock line, and the second clock line.

Each of the plurality of stages may further include two buffer transistors connected to the output terminal configured to output one of the scan signals. A unit transistor may be connected to each of the two buffer transistors.

The start signal input terminal of the stage may receive an output of a previous stage.

The plurality of stages may further include a dummy stage configured to receive an output of a last stage.

In the plurality of pixels, a red pixel configured to display a red color, a blue pixel configured to display a blue color, and two green pixels configured to display a green color, in one unit, may be repeatedly formed.

The plurality of pixels may include a red pixel configured to display a red color, a blue pixel configured to display a blue color, and a green pixel configured to display a green color, and the red pixel, the blue pixel, and the green pixel may be formed in a ratio of 1:1:1.

The plurality of stages may be disposed at opposite sides of the display area. Two stages of the plurality of stages may be connected to one scan line, and the two stages may apply the same scan signal to the one scan line.

According to an exemplary embodiment of the inventive concept, a display device includes a substrate that includes a display area for displaying an image and a non-display area surrounding the display area, a plurality of pixels that are disposed in the display area and each include an organic light emitting diode and a pixel circuit portion configured to operate the organic light emitting diode, a scan driver that is disposed in the non-display area and includes a plurality of stages configured to output scan signals to the plurality of pixels, and a signal controller configured to apply a control signal including a clock signal and a voltage used in the scan driver to the scan driver. A line that applies the control signal or the voltage used in the scan driver may cross at least one of the plurality of stages.

In the non-display area of the substrate, four clock lines, a global clock signal line, and a low voltage line may connect the signal controller and the plurality of stages, and the line crossing the at least one of the plurality of stages may be the global clock signal line or the low voltage line.

Each of the plurality of stages may include an output terminal connected to a scan line configured to transmit a scan signal to the pixel circuit portion, and two buffer transistors connected to the output terminal. The line crossing the at least one of the plurality of stages may pass between the two buffer transistors.

The plurality of stages included in the scan driver may be arranged in n columns, and n may be an integer of 2 or more.

According to an exemplary embodiment of the inventive concept, a display device includes a substrate that includes a display area for displaying an image and a non-display area surrounding the display area, a plurality of pixels that are disposed in the display area, a scan driver that is disposed in the non-display area and includes a plurality of stages configured to output scan signals to the plurality of pixels, four clock lines disposed adjacent to the plurality of stages, a global clock signal line crossing the plurality of stages, and a low voltage line crossing the plurality of stages. Each of the plurality of stages may be connected to only three of the four clock lines.

DETAILED DESCRIPTION OF THE EMBODIMENTS

Figure 1:
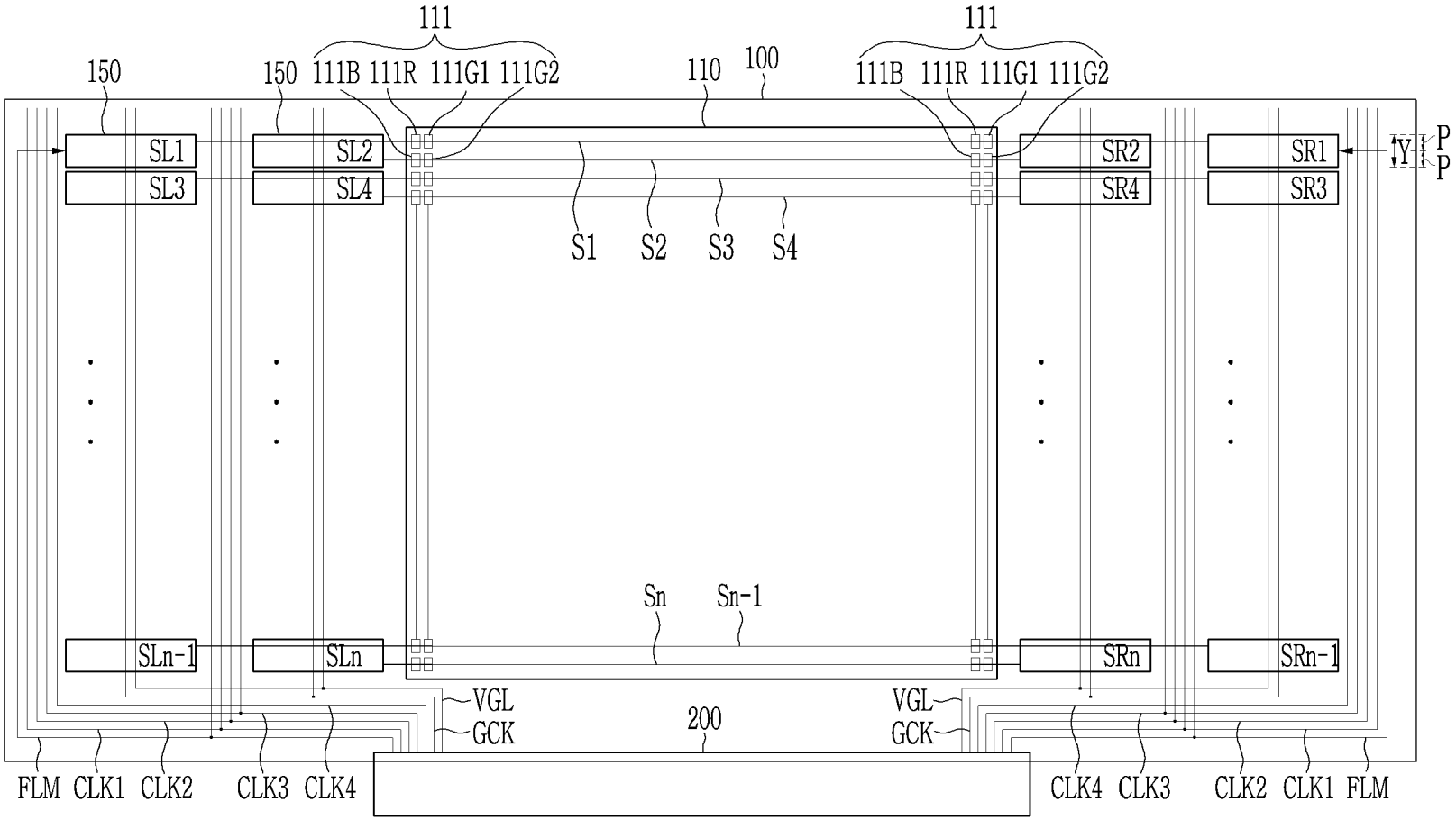
FIG. 1 illustrates a schematic diagram of a display device according to an exemplary embodiment of the inventive concept.

Exemplary embodiments of the inventive concept provide a high resolution display device that may be appropriately integrated even when a size of a stage of a scan driver formed together therewith is larger than the small pixels of the high resolution display device.

Exemplary embodiments of the inventive concept will be described more fully hereinafter with reference to the accompanying drawings. Like reference numerals may refer to like elements throughout this application.

In the drawings, the size and thickness of each element are arbitrarily illustrated for ease of description, and the inventive concept is not necessarily limited to those illustrated in the drawings. The thicknesses of layers, films, panels, regions, areas, etc., may be exaggerated for clarity.

It will be understood that when an element such as a layer, film, region, or substrate is referred to as being "on" another element, it can be directly on the other element or intervening elements may also be present. In contrast, when an element is referred to as being "directly on" another element, there are no intervening elements present. Further, in the specification, the word "on" or "above" means disposed on or below an object portion, and does not necessarily mean disposed on an upper side of the object portion based on a gravitational direction.

Further, throughout the specification, the phrase "a cross-sectional view" means viewing a cross-section formed by vertically cutting a target portion from the side.

Hereinafter, a display device according to an exemplary embodiment of the inventive concept will be described with reference to FIG. 1.

FIG. 1 illustrates a schematic diagram of a display device according to an exemplary embodiment of the inventive concept.

The display device according to the present exemplary embodiment is an organic light emitting diode display device, and displays a high resolution such as 4K or 8K.

The organic light emitting diode display device includes a display area 110 in which a pixel 111 is formed on a substrate 100 to display an image, and a non-display area that is an area other than the display area 110.

The pixel 111 includes a pixel circuit portion including a transistor, a capacitor, and the like formed to operate an organic light emitting diode. In the present exemplary embodiment, the pixel 111 of the display area is repeatedly formed by a red pixel 111R, a blue pixel 111B, and two green pixels 111G1 and 111G2 as one unit. Accordingly, a ratio of the red pixel 111R, the blue pixel 111B, and the green pixels 111G1 and 111G2 is 1:1:2. However, the number and arrangement of pixels is not limited thereto. When two green pixels 111G1 and 111G2 are used as in the present exemplary embodiment, a higher resolution may be displayed using a smaller number of pixels.

The pixel 111 shown as a quadrangle in FIG. 1 does not show an area in which the organic light emitting diode emits light, but schematically shows an area occupied by the pixel circuit portion supplying a current to the organic light emitting diode. A transistor included in the pixel circuit portion of the pixel 111 includes one driving transistor and at least one switching transistor. The at least one switching transistor may include a switching transistor connected to a scan line to transmit a data voltage into the pixel 111 according to a scan signal. In addition, a switching transistor used for initialization or compensation may be further included, and when only one switching transistor is included, it is possible to divide a period in which the one switching transistor operates to perform different operations for each period. The pixel circuit portion further includes a capacitor that maintains a voltage of a gate electrode of the driving transistor. Furthermore, an additional capacitor may be included as needed. For a display device with high resolution, an area occupied by the pixel circuit portion may not be large, and thus, a large number of transistors and capacitors may not be formed, and two or three transistors and one or two capacitors may be included. In addition, all of the pixels 111 may emit light at substantially the same time.

A scan driver is formed in the non-display area, and the scan driver includes a plurality of stages 150 that respectively output one scan signal, and signal lines (FLM, CLK1, CLK2, CLK3, CLK4, GCK, and VGL) that are inputted to and outputted from respective stages 150. The scan signal that is the output of each stage 150 is transmitted to scan lines (S1, S2, S3, S4, . . . , Sn−1, and Sn).

In FIG. 1, the plurality of stages 150 are arranged in two columns, and a height Y of one stage 150 corresponds to about twice a height P of the pixel 111. This is because there is a limit to reducing the area occupied by the stage 150, while the area occupied by the pixel 111 decreases as the resolution of the display device increases. Thus, since it is inevitable to occupy a height higher than the pixels 111, the stages 150 are arranged in two columns in accordance with the heights of the two pixels 111 while forming one stage. In other words, the stages 150 arranged in two columns are disposed at substantially equal distances from one side of the substrate 100 and are arranged in a first direction, e.g., in a direction in which the scan lines extend. However, the inventive concept is not limited thereto, and the stages 150 may be modified to have a different arrangement.

Lines CLK1, CLK2, CLK3, and CLK4 for applying a clock signal are disposed far from the display area 110 based on one stage 150, and a line GCK for applying a global clock signal and a line VGL for applying a low voltage cross the stage 150. The lines CLK1, CLK2, CLK3, and CLK4 for applying the clock signal are disposed as far as possible from the display area 110 so that the pixel 111 in the display area 110 may be less affected whenever the clock signal is changed.

The reason why the line GCK for applying the global clock signal and the line VGL for applying the low voltage are arranged across a center portion of the stage 150 is that the area occupied by the stage 150 may increase when a connecting line is formed from the line GCK and the line VGL to a portion in the stage 150. The line GCK and the line VGL may be disposed adjacent to the portion of the stage 150 that needs to be connected. The lines CLK1, CLK2, CLK3, and CLK4 for applying the clock signal to the stage 150 disposed near the display area 110 are disposed between the stages 150 arranged in two columns.

The line FLM for transmitting a start signal is disposed outside the lines CLK1, CLK2, CLK3, and CLK4 for applying the clock signal to the stage 150 disposed far from the display area 110. An additional line may be disposed outside the line FLM for transmitting the start signal, and in exemplary embodiments of the inventive concept, a driving low voltage line or a test line for testing the display device may be disposed (see FIG. 5).

In FIG. 1, the scan driver including the plurality of stages 150 is disposed at the left and right sides of the display area 110. In the drawing, the stage 150 disposed at the left side of the display area 110 is represented by SL, and the stage 150 disposed at the right side thereof is represented by SR. A number attached thereto indicates that a given stage 150 applies a scan signal to the scan line of the corresponding number. In addition, both SL1 and SR1 transmit a scan signal to the first scan line S1, and the signals outputted from SL1 and SR2 are the same scan signal. As such, the reason for forming the scan drivers for outputting the same scan signal at opposite sides of the display area 110 is because the display area 110 has a large number of pixels 111 as the display area 110 increases in resolution. Thus, when the scan signal is applied only from one side, since the other side receives a delayed scan signal, a display may be abnormal. When there is no such problem, the scan driver may be formed only at one side.

The stages 150 arranged in two columns may have a structure in which a carry signal is received.

The non-display area may further include various lines such as a line for applying a data voltage, a test line for a test, a line for applying a driving voltage, and a line for applying a pixel initialization voltage.

A signal controller 200 is formed at one side of the non-display area, and a control signal including a clock signal and a voltage used in the scan driver are provided through the signal controller 200. The signal controller 200 also provides a data voltage used in the pixels 111.

The signal controller 200 may be mounted on the substrate 100 or may be connected to the substrate 100 through a flexible substrate.

Hereinafter, a structure and a connection relationship of the stage 150 will be described in more detail with reference to FIG. 2 to FIG. 4.

First, the stage 150 will be described with reference to FIG. 2.

Figure 2:
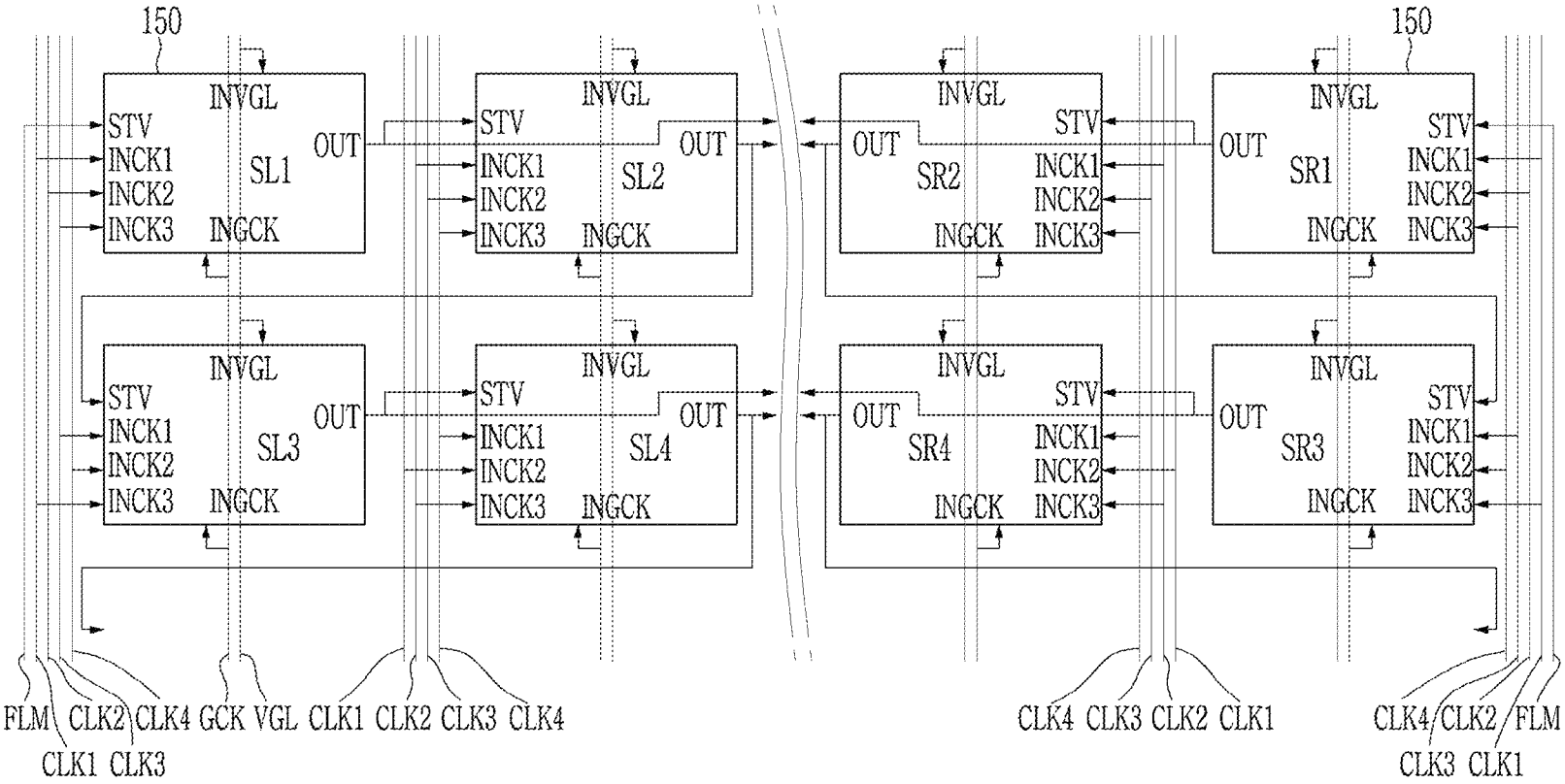
FIG. 2 illustrates a block diagram of a scan driver according to an exemplary embodiment of the inventive concept.

FIG. 2 illustrates a block diagram of a scan driver according to an exemplary embodiment of the inventive concept.

One stage 150 has six input terminals STV, INCK1, INCK2, INCK3, INGCK, and INVGL, and one output terminal OUT.

A start signal input terminal STV receives a start signal through the line FLM for transmitting the start signal or a scan signal from a previous stage 150. In other words, the stages SR1 and SL1 receive the start signal from the line FLM that transmits the start signal, and the stages 150 thereafter receive the scan signal of the previous stage 150. In exemplary embodiments of the inventive concept, the carry signal of the previous stage 150 may be applied, which may be a signal having substantially the same timing as the scan signal.

Three clock input terminals INCK1, INCK2, and INCK3 are connected to three of the lines CLK1, CLK2, CLK3, and CLK4 for applying four clock signals. For example, in the stages SR1 and the SL1, first to third clock lines CLK1, CLK2, and CLK3 are connected to the three clock input terminals INCK1, INCK2, and INCK3, respectively. In the stages SR2 and SL2, second to fourth clock lines CLK2, CLK3, and CLK4 are connected to the three clock input terminals INCK1, INCK2, and INCK3, respectively. In the stages SR3 and SL3, third and fourth and first clock lines CLK3, CLK4, and CLK1 are connected to the three clock input terminals INCK1, INCK2, and INCK3, respectively. In the stages SR4 and SL4, fourth, first and second clock lines CLK4, CLK1 and CLK2 are connected to the three clock input terminals INCK1, INCK2, and INCK3, respectively. In this way, three clock lines are determined to be connected to the next stage.

The global clock signal input terminal INGCK and the low voltage input terminal INVGL are connected to the line GCK for applying the global clock signal and the line VGL for applying the low voltage to receive the global clock signal and the low voltage, respectively.

The output terminal OUT of the stage 150 outputs the scan signal to the scan line connected thereto, and transmits the scan signal to the start signal input terminal STV of the next stage 150 to be used as the start signal. In exemplary embodiments of the inventive concept, the carry signal having substantially the same timing as the scan signal may be transmitted to the start signal input terminal STV of the next stage 150.

Meanwhile, in exemplary embodiments of the inventive concept, the stage 150 may further include an input terminal configured to receive a scan signal or a carry signal of a subsequent stage 150, and in this case, an output of the subsequent stage 150 is also transmitted to the stage 150 disposed at a front end thereof, e.g., a previous stage 150. In exemplary embodiments of the inventive concept, it may be transmitted to a stage 150 before the present stage 150 or to a stage 150 two or more stages before the present stage 150.

FIG. 2 also shows a structure in which the global clock signal line GCK and the low voltage line VGL are also formed to cross the stage 150 and are disposed to cross a central portion of the stage 150.

A detailed structure and operation of the stage 150 having such a connection relationship will be described with reference to FIG. 3 and FIG. 4.

Figure 3:
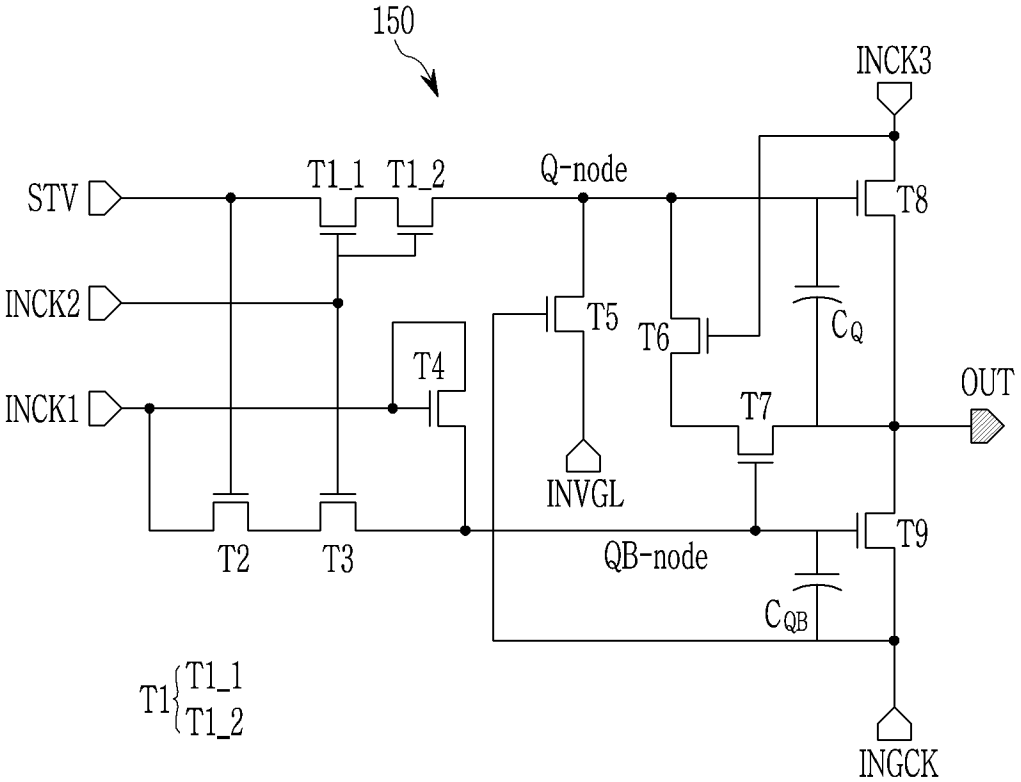
FIG. 3 illustrates a circuit diagram of one stage of a scan driver according to an exemplary embodiment of the inventive concept.
Figure 4:
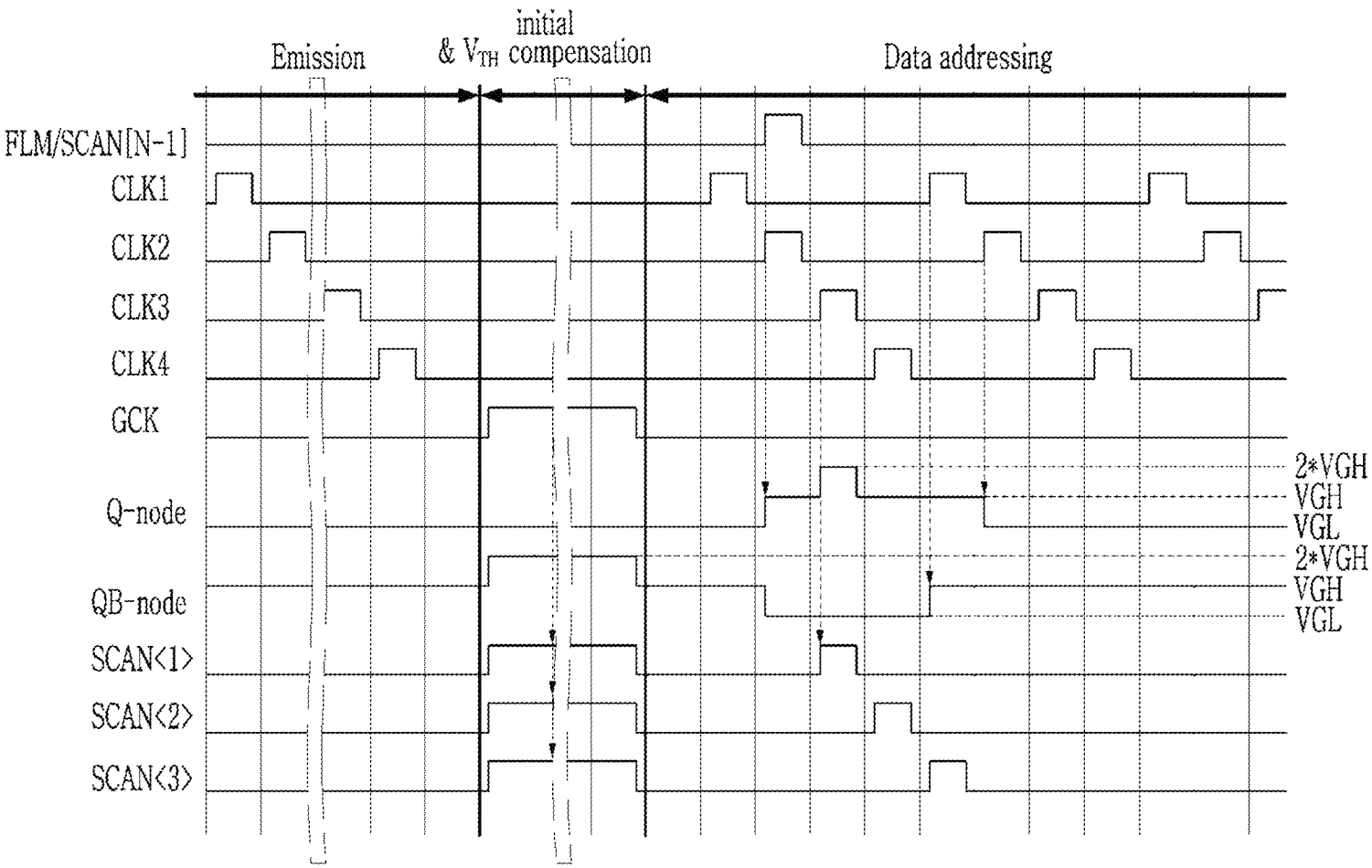
FIG. 4 illustrates a waveform diagram of a signal applied to the stage of FIG. 3 and a signal outputted therefrom according to an exemplary embodiment of the inventive concept.

FIG. 3 illustrates a circuit diagram of one stage of a scan driver according to an exemplary embodiment of the inventive concept, and FIG. 4 illustrates a waveform diagram of a signal applied to the stage of FIG. 3 and a signal outputted therefrom according to an exemplary embodiment of the inventive concept.

One stage 150 has first to ninth transistors T1, T2, T3, T4, T5, T6, T7, T8, and T9, and two capacitors $C_Q$ and $C_{QB}$.

First, the first transistor T1 has a structure in which two transistors T1_1 and T1_2 are connected as one transistor. In other words, gate electrodes of the two transistors T1_1 and T1_2 receive the same signal, and an output electrode of one transistor T1_1 and an input electrode of the other transistor T1_2 are connected.

The gate electrode of the first transistor T1 is connected to the second clock input terminal INCK2, the input electrode thereof is connected to the start signal input terminal STV, and the output electrode thereof is connected to a Q-node. Accordingly, the first transistor T1 is controlled by a clock signal inputted to the second clock input terminal INCK2, and receives the start signal or the output signal of the previous stage 150 through the start signal input terminal STV, and outputs it to or blocks it from the Q-node.

The gate electrode of the second transistor T2 is connected to the start signal input terminal STV, the input electrode is connected to the first clock input terminal INCK1, and the output electrode is connected to the input electrode of the third transistor T3. Accordingly, the second transistor T2 is controlled by the start signal inputted through the start signal input terminal STV or the output signal of the previous stage 150 to output or block the clock signal inputted from the first clock input terminal INCK1 to the third transistor T3.

The gate electrode of the third transistor T3 is connected to the second clock input terminal INCK2, the input electrode thereof is connected to the output electrode of the second transistor T2, and the output electrode thereof is connected to a QB-node. Accordingly, the third transistor T3 is controlled by a clock signal inputted from the second clock input terminal INCK2 to transmit or block the output of the second transistor T2 to the QB-node.

The gate electrode and the input electrode of the fourth transistor T4 are connected to the first clock input terminal INCK1, and the output electrode thereof is connected to the QB-node. Accordingly, the fourth transistor T4 transmits a corresponding voltage to the QB-node when the clock signal inputted to the first clock input terminal INCK1 is a voltage for turning on the fourth transistor T4. In the present exemplary embodiment, since the fourth transistor T4 is an n-type transistor, when a high voltage of the clock signal is applied thereto, the fourth transistor transmits the corresponding high voltage to the QB-node, and when a low voltage of the clock signal is applied thereto, the fourth transistor T4 blocks the corresponding low voltage.

The gate electrode of the fifth transistor T5 is connected to the global clock signal input terminal INGCK, the input electrode thereof is connected to the low voltage input terminal INVGL, and the output electrode thereof is connected to the Q-node. Accordingly, the fifth transistor T5 is controlled by the global clock signal inputted from the global clock signal input terminal INGCK to transmit or block the low voltage to the Q-node.

The gate electrode of the sixth transistor T6 is connected to the third clock input terminal INCK3, the input electrode thereof is connected to the Q-node, and the output electrode thereof is connected to the input electrode of the seventh transistor T7. The gate electrode of the seventh transistor T7 is connected to the QB-node, the input electrode thereof is connected to the output electrode of the sixth transistor T6, and the output electrode thereof is connected to the output terminal OUT of the stage 150.

The sixth transistor T6 and the seventh transistor T7 serve to connect the Q-node and the output terminal OUT of the stage 150 when the clock signal inputted to the third clock input terminal INCK3 has a high voltage and the QB-node has a high voltage. Since the QB-node has a low voltage for a predetermined period based on a period where a high voltage (gate on voltage) is outputted as a scan signal, the Q-node and the output terminal OUT of the stage 150 are not connected during the predetermined period. However, when the clock signal inputted to the third clock input terminal INCK3 has a high voltage in a period other than the predetermined period, e.g., in a period in which the QB-node has a high voltage, the voltage of the Q-node is outputted to the output terminal OUT of the stage 150. Since the Q-node has a high voltage for the predetermined period based on a period where the high voltage (gate on voltage) is outputted as the scan signal, and has a low voltage in the remaining period, the low voltage of the Q-node is outputted to the output terminal OUT of the stage 150 so that the scan signal is maintained at a low voltage.

The gate electrode of the eighth transistor T8 is connected to the Q-node, the input electrode thereof is connected to the third clock input terminal INCK3, and the output electrode thereof is connected to the output terminal OUT of the stage 150. Although the eighth transistor T8 is turned on according to the voltage of the Q-node and outputs the clock signal inputted to the third clock input terminal INCK3, when the clock signal inputted to the third clock input terminal INCK3 has a high voltage, as the voltage of the Q-node is boosted up, the eighth transistor T8 is operated to output a high voltage to the output terminal OUT of the stage 150.

The gate electrode of the ninth transistor T9 is connected to the QB-node, the input electrode thereof is connected to the global clock signal input terminal INGCK, and the output electrode thereof is connected to the output terminal OUT of the stage 150. The ninth transistor T9 is turned on according to the voltage of the QB-node, and outputs the global clock signal inputted to the global clock signal input terminal INGCK.

Meanwhile, a Q-node capacitor $C_Q$ for storing and maintaining the voltage of the Q-node is formed between the gate electrode of the eighth transistor T8 and the output terminal OUT of the stage 150. In addition, a QB-node capacitor $C_{QB}$ for storing and maintaining the voltage of the QB-node is formed between the gate electrode of the ninth transistor T9 and the global clock signal input terminal INGCK.

The eighth transistor T8 and the ninth transistor T9 are connected to the output terminal OUT and are responsible for the output, and the eighth transistor T8 and ninth transistor T9 are together referred to as a buffer transistor. Referring to FIG. 5 to FIG. 10, the global clock signal line GCK and the low voltage line VGL are formed while crossing the stage 150, and are disposed between two buffer transistors of the stage 150. Accordingly, it is possible to prevent the height of the stage 150 from increasing while forming a line connecting the global clock signal line GCK and the low voltage line VGL.

Operations according to signals applied to the stage 150 having the above-described structure are shown in FIG. 4. FIG. 4 shows the waveform diagram in which the first clock line CLK1, the second clock line CLK2, and the third clock line CLK3 are applied to the three clock input terminals INCK1, INCK2, and INCK3 of the stage 150, respectively.

Hereinafter, the waveform diagram of FIG. 4 will be described with reference to the structure of FIG. 3.

The waveform diagram of FIG. 4 is divided into three periods (an emission period (Emission), an initialization and compensation period (initial & VTH compensation), and a data addressing period (Data addressing)). The data addressing period, which is the most basic period, is first described.

The clock signal applied through the four clock lines CLK1, CLK2, CLK3, and CLK4 is a clock voltage having a high voltage only during a 1H period of 4H periods, and a low voltage during the remaining periods, as shown in FIG. 4. The clock signal applied to the first clock line CLK1 becomes a high voltage for a first 1H, the clock signal of the second clock line CLK2 becomes a high voltage for a second 1H, the clock signal of the third clock line CLK3 becomes a high voltage for a third 1H, and the clock signal of the fourth clock line CLK4 finally becomes a high voltage for a fourth 1H. After that, the clock signal applied to the first clock line CLK1 again becomes a high voltage for 1H, and this process is repeated except for the initialization and compensation period.

The start signal, or the scan signal of the previous stage 150, has a high voltage only for 1H of one frame, and has a low voltage in other periods.

First, the 1H period (first data addressing period) in which the clock signal applied to the first clock line CLK1 has a high voltage will be described.

In the first data addressing period, the fourth transistor T4 is turned on to transmit the high voltage of the clock signal to the QB-node so that the voltage of the QB-node is maintained at the high voltage VGH.

Thereafter, the high voltage is applied to the start signal or the scan signal of the previous stage 150 in the 1H period (second data addressing period) in which the clock signal applied to the second clock line CLK2 has a high voltage. Accordingly, the first transistor T1, the second transistor T2, and the third transistor T3 are turned on in the second data addressing period. The high voltage is applied to the Q-node by the first transistor T1 so that the voltage of the Q-node is changed to the high voltage VGH, and the high voltage VGH is stored in the Q-node capacitor $C_Q$. In addition, the second transistor T2 and the third transistor T3 are turned on, and thus the clock signal applied to the first clock line CLK1, e.g., a low voltage VGL, is applied to the QB-node, to convert the voltage of the QB-node from the high voltage VGH into the low voltage VGL. In this case, the low voltage VGL is stored in the QB-node capacitor $C_{QB}$.

Thereafter, the high voltage is output as the scan signal through the eighth transistor T8 in the 1H period (third data addressing period) in which the clock signal applied to the third clock line CLK3 has a high voltage. (See SCAN <1>) Here, as the clock signal inputted to the input electrode of the eighth transistor T8 is changed from a low voltage to a high voltage, the voltage of the gate electrode of the eighth transistor T8 is also boosted, and thus the high voltage VGH is doubled to a high voltage (2*VGH). As a result, the eighth transistor T8 is turned on, and the clock signal inputted to the input electrode thereof is output as the scan signal. In this case, the outputted scan signal may also be boosted and outputted.

Thereafter, in the 1H period (fourth data addressing period) in which the clock signal applied to the fourth clock line CLK4 has a high voltage, the voltage of the gate electrode of the eighth transistor T8 may be again changed to the high voltage VGH while the clock signal applied to the third clock line CLK3 is changed to a low voltage, and the eighth transistor T8 may be turned off.

Thereafter, when the clock signal applied to the first clock line CLK1 is in the 1H period (fifth data addressing period) in which the clock signal again has a high voltage, the fourth transistor T4 is turned on to change the voltage of the QB-node to the high voltage VGH, and the high voltage VGH is stored in the QB-node capacitor $C_{QB}$. When the voltage of the QB-node is changed to the high voltage VGH, the ninth transistor T9 is turned on, and thus the global clock signal is outputted as the scan signal, and in this case, since the global clock signal has a low voltage, the low voltage is outputted.

Thereafter, when the clock signal applied to the second clock line CLK2 is in the 1H period (sixth data addressing period) in which the clock signal again has a high voltage, unlike the second data addressing period, the low voltage is applied to the start signal or the scan signal of the previous stage 150. As a result, in the sixth data addressing period, the third transistor T3 is turned on, but the second transistor T2 is maintained in a turned off state, and thus the voltage of the QB-node is not changed. In addition, although the first transistor T1 is turned on, the voltage of the Q-node is changed from the high voltage VGH to the low voltage VGL since the inputted start signal or the scan signal of the previous stage 150 is a low voltage.

Thereafter, when the clock signal applied to the third clock line CLK3 is in the 1H period (seventh data addressing period) in which the clock signal again has a high voltage, the sixth transistor T6 is turned on. In this case, since the seventh transistor T7 has been maintained in a turned on state from the fifth data addressing period in which the voltage of the QB-node is changed to the high voltage, the Q-node and the output terminal OUT of the stage 150 are connected. In other words, the voltage of the Q-node is outputted as the scan signal, and in this case, since the Q-node has the low voltage VGL, the low voltage is outputted as the scan signal.

After that, even though the clock signal flowing through the clock lines is changed, the voltage of the Q-node is maintained at the low voltage VGL, and the voltage of the QB-node is maintained at the high voltage VGH. This state is maintained not only in the data addressing period but also in a light emitting period (e.g., the emission period). In other words, in the light emitting period, even though the clock signal is changed, the voltage of the Q-node is maintained at the low voltage VGL, and the voltage of the QB-node is maintained at the high voltage VGH, so that the low voltage is outputted as the scan signal.

Thereafter, when the light emitting period ends and the initialization and compensation period begins, all the clock signals become a low voltage, and thus only the global clock signal becomes a high voltage.

When the global clock signal becomes the high voltage, the fifth transistor T5 is turned on to change the voltage of the Q-node to a low voltage applied from the low voltage line VGL to initialize it. In this case, since the ninth transistor T9 is turned on, the inputted global clock signal that is the high voltage is also outputted to the output terminal OUT of the stage 150.

Since the global clock signal is equally connected to all the stages 150, the initialization and compensation operations are performed for all the pixels 111 while the same high voltage is applied to all the scan lines.

In contrast, in the data addressing period, three clock lines connected to all stages 150 are selected from four clock lines CLK1, CLK2, CLK3, and CLK4, and since a time point at which the high voltage of the start signal or the scan signal of the previous stage 150 is transmitted varies, the high voltage is sequentially applied to one scan line for each 1H period.

FIG. 3 and FIG. 4 show an exemplary embodiment in which the nine transistors T1, T2, T3, T4, T5, T6, T7, T8, and T9 included in the stage 150 are n-type transistors. However, according to exemplary embodiments of the inventive concept, they may be p-type transistors, and in this case, when a low voltage is applied thereto, since they are turned on, the high voltage and the low voltage should be switched in FIG. 4. In addition, the low voltage input terminal INVGL of FIG. 3 may be changed to a high voltage input terminal to which a high voltage is inputted.

Since the stage 150 is formed on the substrate 100 through the same process as the pixel 111, when the transistors included in the pixel 111 are n-type transistors, the stage 150 may be formed of n-type transistors, and when the transistors included in the pixel 111 are p-type transistors, the stage 150 may be formed of p-type transistors.

The stage 150 having the circuit as shown in FIG. 3 is formed in two columns as shown in FIG. 1, and the stage 150 arranged in two columns will be described in detail with reference to FIG. 5 to FIG. 12.

First, an overall structure thereof will be described with reference to FIG. 5.

Figure 5:
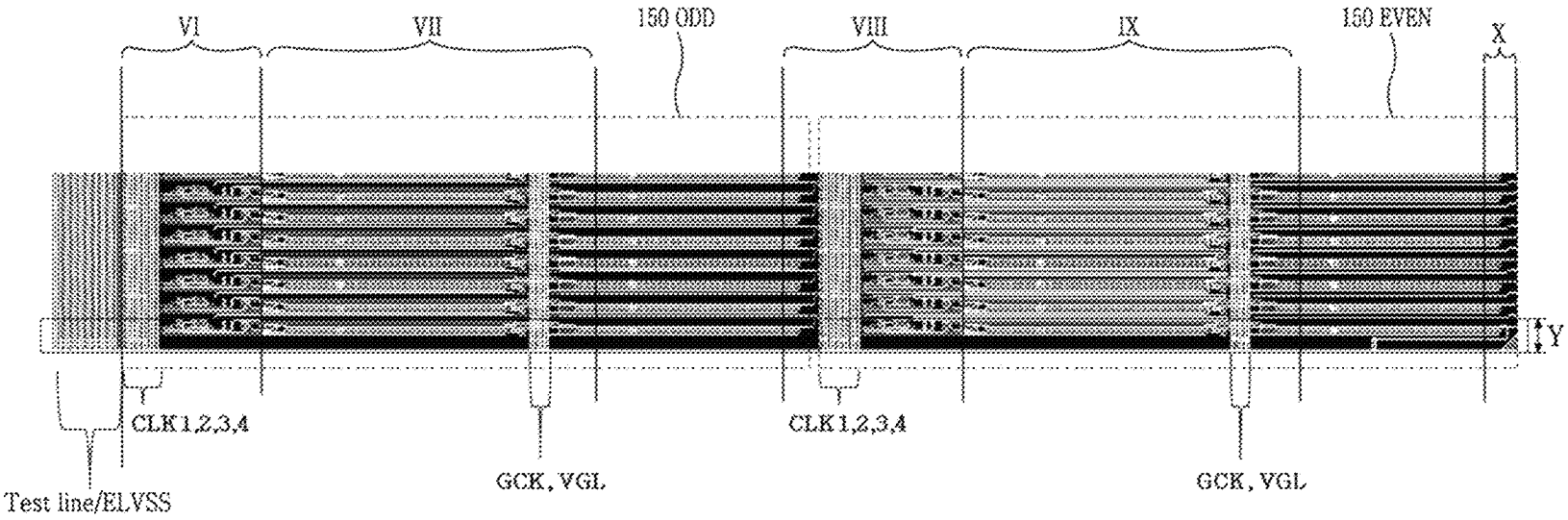
FIG. 5 illustrates a schematic layout view of a scan driver according to an exemplary embodiment of the inventive concept.

FIG. 5 illustrates a schematic layout view of a scan driver according to an exemplary embodiment of the inventive concept.

FIG. 5 illustrates the stage 150 arranged in two columns disposed at the left side of the display area 110 and included in the scan driver disposed in the non-display area in FIG. 1. In FIG. 5, a test line or a driving low voltage line ELVSS is disposed at the leftmost side, first four clock lines (CLK 1, 2, 3, 4) are disposed at the right side thereof, and the stage 150 of the first column is disposed at the right side thereof. An area occupied by a stage 150 ODD of the first column is occupied until the second four clock lines (CLK 1, 2, 3, 4) shown in a center of FIG. 5 are formed. The second four clock lines (CLK 1, 2, 3, 4) are disposed at the right side thereof, a stage 150 EVEN of the second column is disposed at the right side thereof, and the display area 110 (not shown in FIG. 5) is disposed at the right side thereof. Here, the test line is a line for applying a signal for testing the display device, and the driving low voltage line ELVSS is a line for applying a driving low voltage during the operation of the pixel 111.

In FIG. 5, two signal lines GCK and VGL pass through central portions of the stage 150 ODD of the first column and the stage 150 EVEN of the second column. The two stages 150 and the two signal lines GCK and VGL are provided so that the area (or height) occupied by the stage 150 due to a connecting line connecting them does not increase. In other words, since the height Y occupied by the stage 150 may be increased by the width of the connecting line, the connecting line is minimized to minimize the height Y. In addition, referring to FIG. 1, the height Y of the stage 150 may have twice the height P of the pixel 111. Herein, the pixel 111 may refer to a pixel circuit portion including a transistor, a capacitor, and the like that are formed to operate the organic light emitting diode.

To show the structure of FIG. 5 in more detail, after dividing and enlarging the structure of FIG. 5 into FIG. 6 to FIG. 10, divided and enlarged portions will be described. In other words, a VI portion of FIG. 5 is shown in detail in FIG. 6, a VII portion of FIG. 5 is shown in detail in FIG. 7, a VIII portion of FIG. 5 is shown in detail in FIG. 8, a IX portion of FIG. 5 is shown in detail in FIG. 9, and an X portion of FIG. 5 is shown in detail in FIG. 10.

Figure 9:
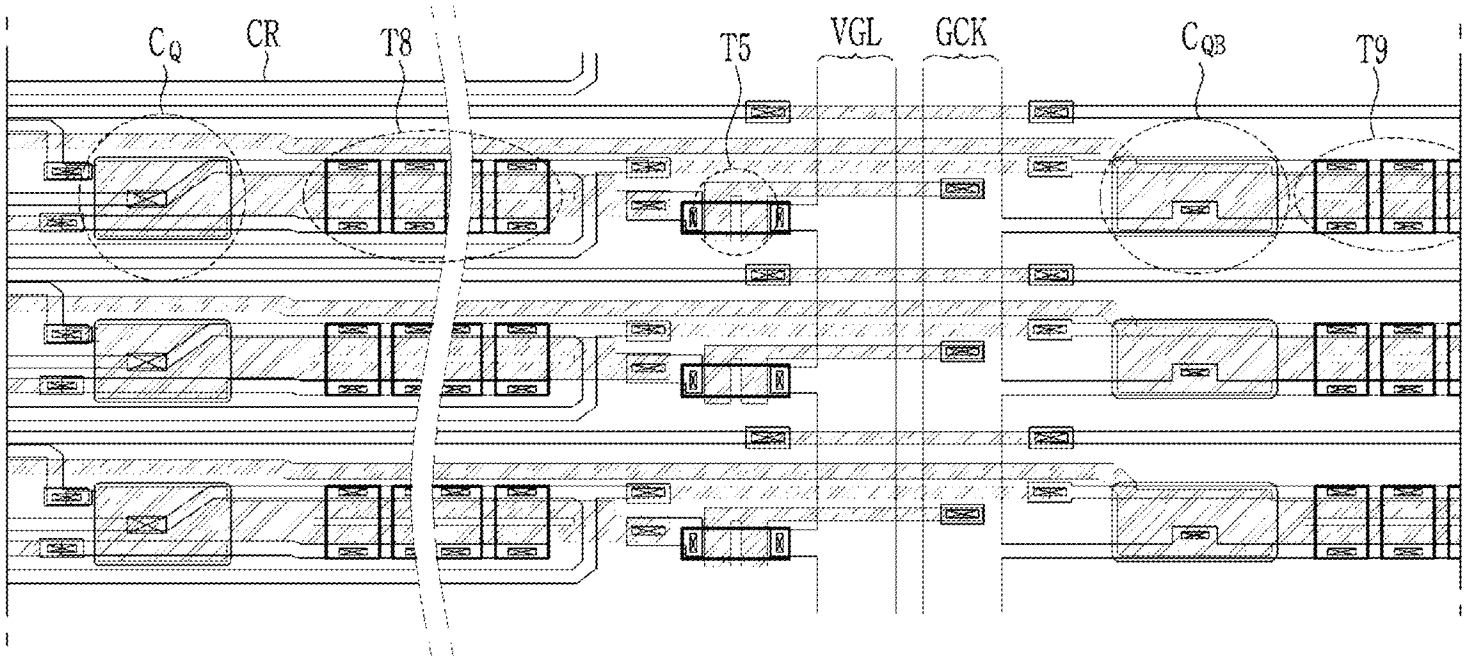
Figure 10:
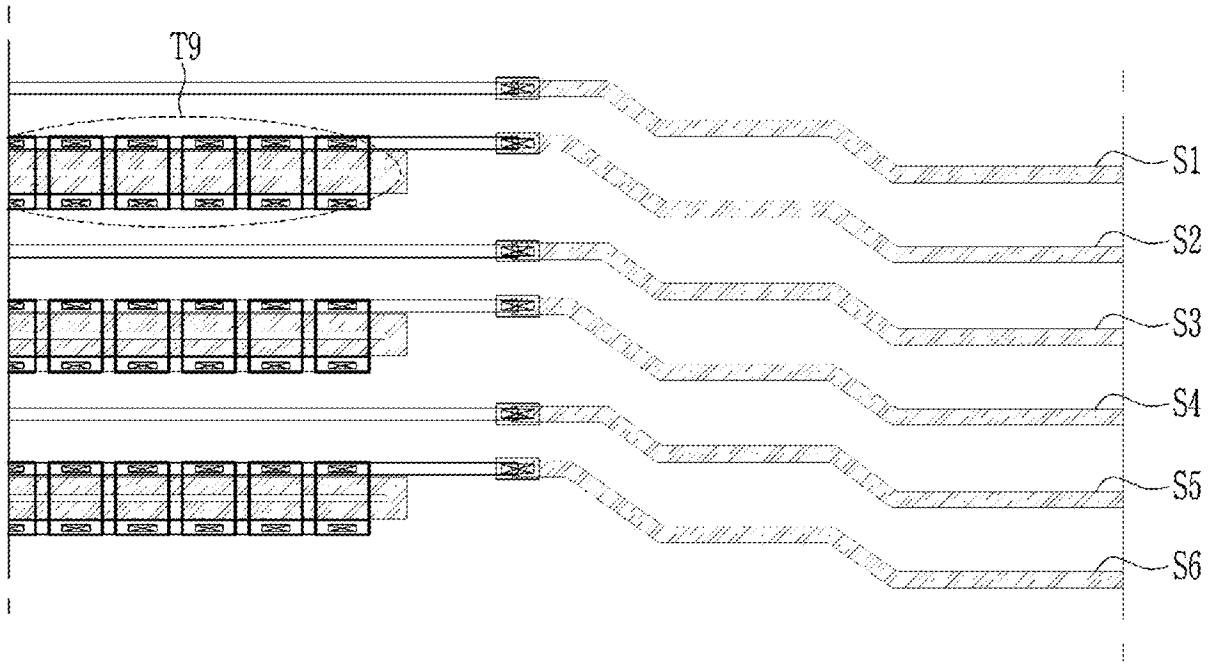
Figure 11:
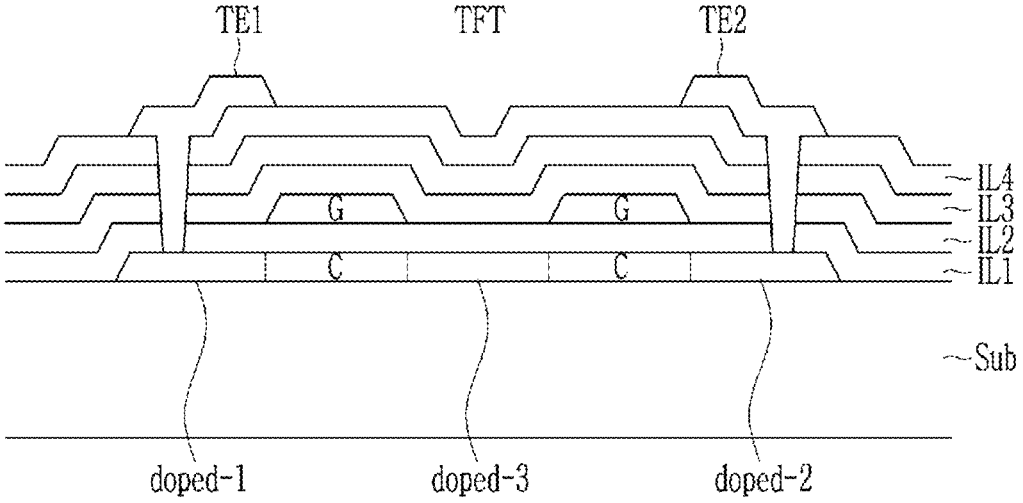
FIG. 11 and FIG. 12 illustrate cross-sectional views of a portion of the scan driver of FIG. 5 according to an exemplary embodiment of the inventive concept.
Figure 12:
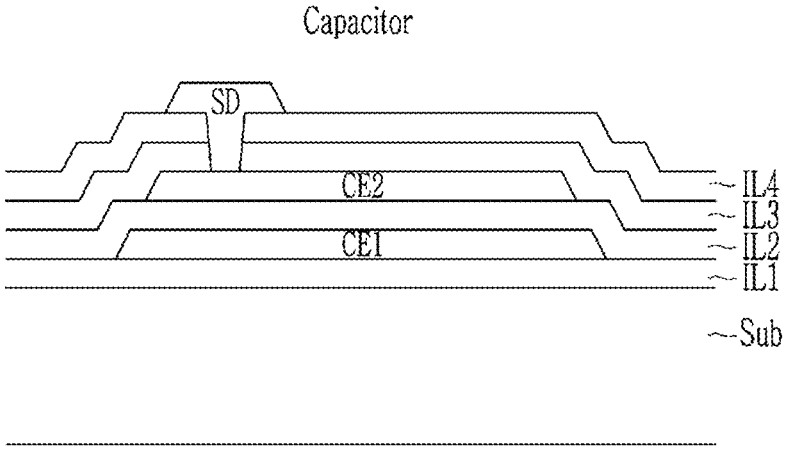

FIG. 6 to FIG. 10 illustrate detailed layout views in which the scan driver of FIG. 5 is divided according to an exemplary embodiment of the inventive concept, and FIG. 11 and FIG. 12 illustrate cross-sectional views of a portion of the scan driver of FIG. 5 according to an exemplary embodiment of the inventive concept.

In FIG. 6 to FIG. 10, a portion surrounded by a thick solid line indicates a semiconductor layer, and a portion surrounded by a hatched line indicates a first conductive layer. The semiconductor layer may be a polycrystalline semiconductor layer, and a portion not overlapping the first conductive layer, which is shown as a hatched portion of the semiconductor layer, may be doped, while a portion overlapping the first conductive layer may not be doped. A second conductive layer used in a portion of forming the capacitor and a third conductive layer formed of the remaining lines are shown by a general solid line.

Figure 6:
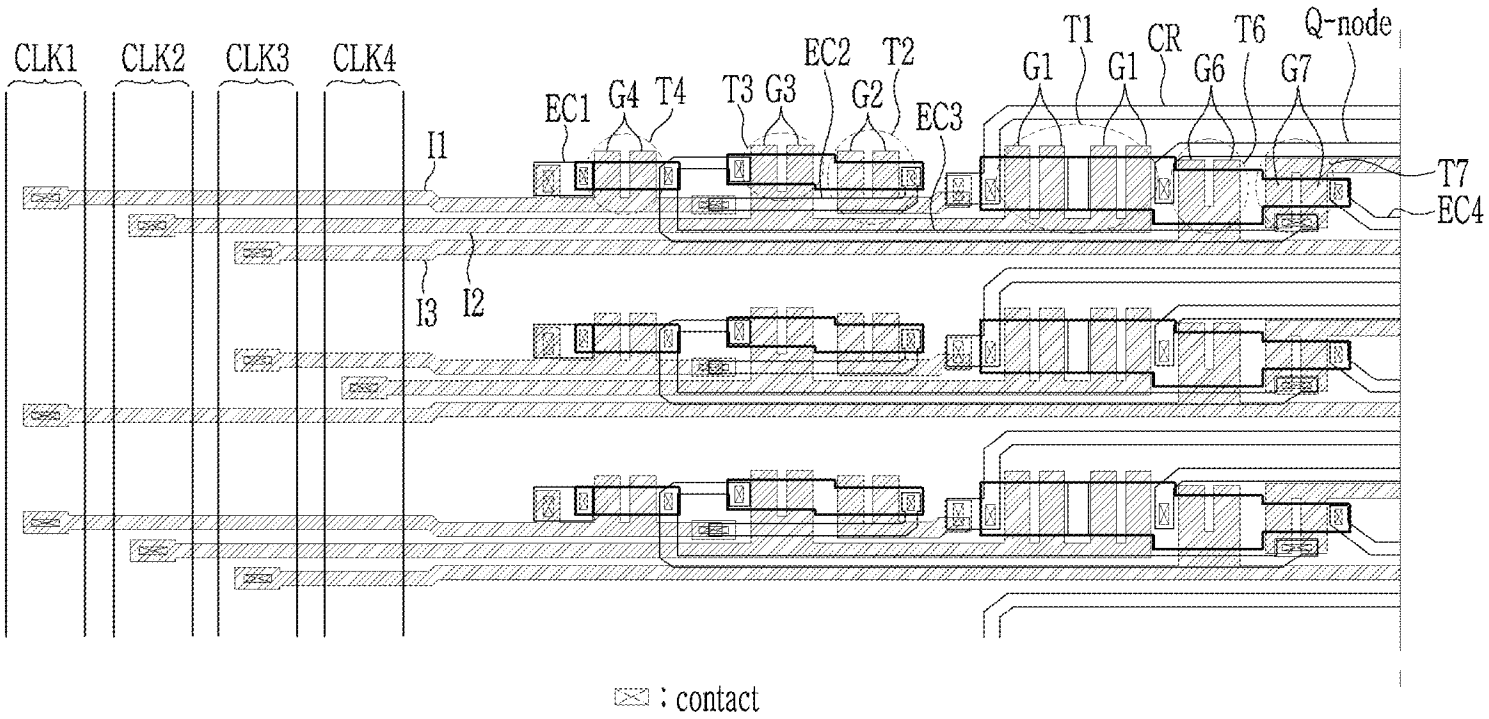
FIG. 6 to FIG. 10 illustrate detailed layout views in which the scan driver of FIG. 5 is divided according to an exemplary embodiment of the inventive concept.

Referring to FIG. 6, the first transistor T1, the second transistor T2, the third transistor T3, the fourth transistor T4, the sixth transistor T6, and the seventh transistor T7 of the stage 150 are shown from a portion where the four clock lines CLK1, CLK2, CLK3, and CLK4 and the stage 150 are connected.

The first to third clock lines CLK1, CLK2, and CLK3 of the four clock lines CLK1, CLK2, CLK3, and CLK4 are connected to the inside of the stage 150 through an I1 line, an I2 line, and an I3 line, respectively.

The I1 line is extended to form a gate electrode G4 of the fourth transistor T4, and is further extended to be connected to the input electrode of the second transistor T2 through an EC2 line. The I1 line is also connected to the input electrode of the fourth transistor T4 through an EC1 line so that the fourth transistor T4 has a diode-connected structure.

A structure in which the fourth transistor T4 has two gate electrodes G4 is provided, and the other transistors T1, T2, T3, T5, T6, and T7 have a similar structure. A cross-sectional structure of such a transistor is shown in detail in FIG. 11. A structure of the transistor will be described below.

The I2 line is extended to form a gate electrode G3 of the third transistor T3, and is further extended to form a gate electrode G1 of the first transistor T1. The first transistor T1 has a structure in which two transistors are formed in succession.

Figure 7:
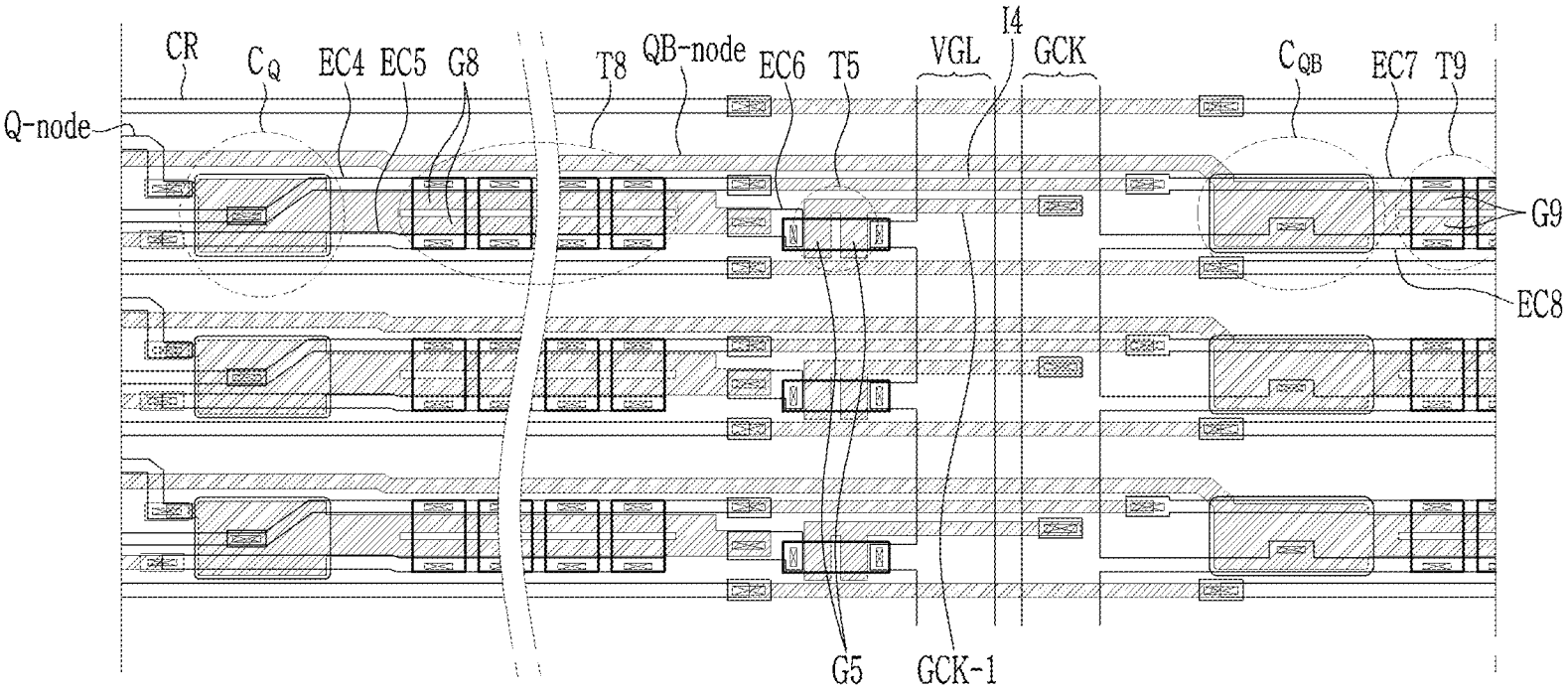

The I3 line is extended to form a gate electrode G6 of the sixth transistor T6, and referring to FIG. 7, it is further extended to be connected to the input electrode of the eighth transistor T8 through an EC5 line.

An EC3 line is connected to the output electrode of the third transistor T3, is also connected to the output electrode of the fourth transistor T4, and is further extended to be connected to a gate electrode G7 of the seventh transistor T7. Referring to FIG. 7, the gate electrode G7 of the seventh transistor T7 is extended to form a QB-node line, and is further extended to form the first electrode of the QB-node capacitor $C_{QB}$.

A gate electrode G2 of the second transistor T2 extends to be connected to a CR line.

The CR line is connected to the input electrode of the first transistor T1 in addition to the gate electrode G2 of the second transistor T2. In addition, referring to FIG. 7, FIG. 8, and FIG. 9, the CR line is further extended to be connected to the output electrode of the eighth transistor T8 of a previous stage. In a case of the first stage, the start signal may be applied thereto.

The Q-node line is electrically connected to semiconductor layers in middle portions of the first transistor T1 and the sixth transistor T6, and is connected to the output electrode of the first transistor T1 and the input electrode of the sixth transistor T6. The Q-node line is extended, and referring to FIG. 7, it is connected to the second electrode of the Q-node capacitor $C_Q$.

An EC4 line is connected to the output electrode of the seventh transistor T7, and referring to FIG. 7, it is extended to be electrically connected to the first electrode of the Q-node capacitor $C_Q$, and is further extended to form the output electrode of the eighth transistor T8.

In FIG. 6, the semiconductor layers of some transistors are connected to each other, and since the portion not overlapping the gate electrode is doped to have a conductive characteristic, the two transistors are electrically connected to each other through a doped region that is the doped portion of the semiconductor layer.

Hereinafter, a structure of FIG. 7 will be described, and the contents described above with reference to FIG. 6 will be omitted.

In FIG. 7, a gate electrode G8 of the eighth transistor T8 is extended left and right, and it is extended and enlarged to the left side to form the first electrode of the Q-node capacitor $C_Q$. In addition, it is extended to the right side to be connected to the output electrode of the fifth transistor T5 through an EC6 line. The gate electrode G8 of the eighth transistor T8 is provided with an opening in a center portion thereof and overlaps the semiconductor layer, and a portion of the semiconductor layer is electrically connected to the EC4 line and the remaining portion thereof is electrically connected to the EC5 line. Accordingly, the EC5 line is configured as the input electrode, the EC4 line is configured as the output electrode, and each of them is electrically connected to the doped region of the semiconductor layer. The eighth transistor T8 configures a unit eighth transistor T8 on the basis of one semiconductor layer, and since a large number of unit eighth transistors T8 are included, only some of them are illustrated in FIG. 7. The unit eighth transistors T8 are electrically connected to another by the EC4 line and the EC5 line.

Figure 8:
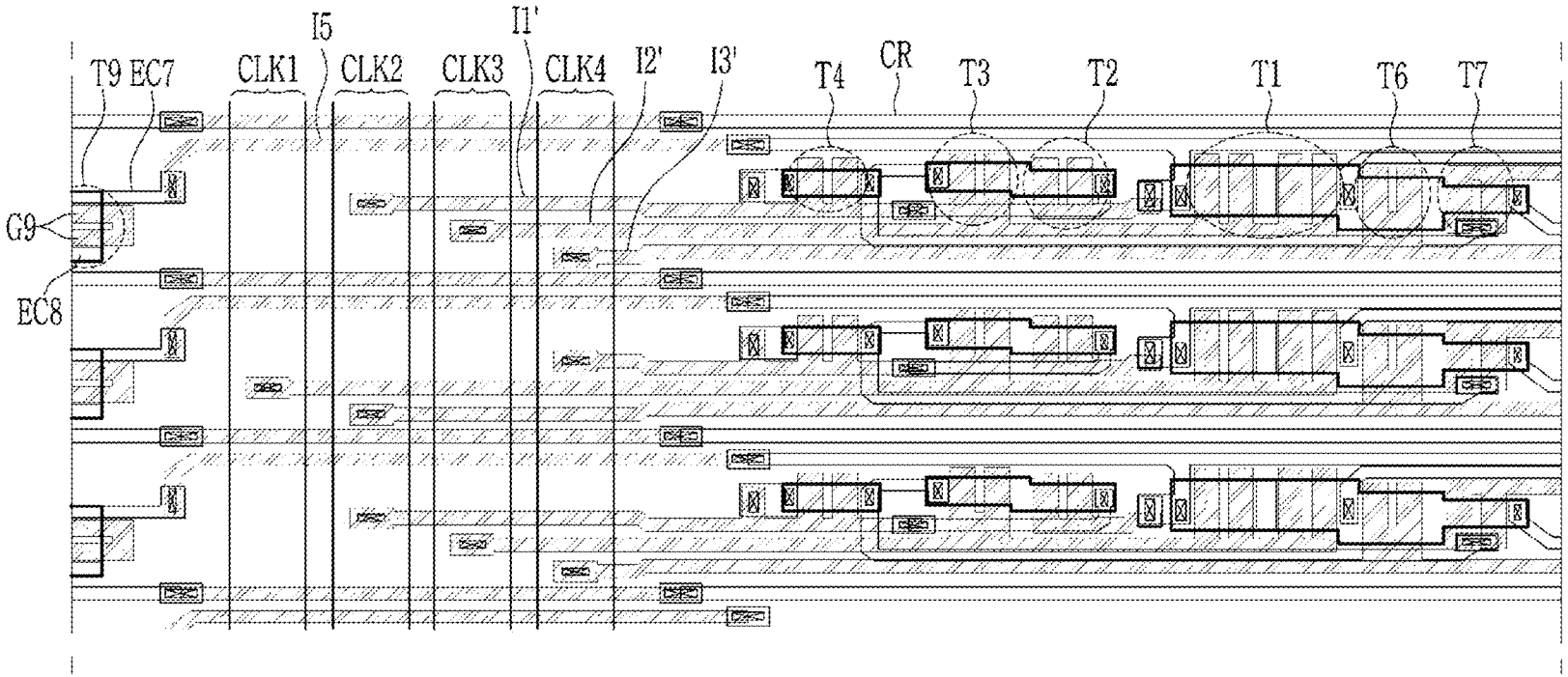

The EC4 line is further extended to be connected to an 14 line, the 14 line is connected to an EC7 line, and the EC7 line forms the output electrode of the ninth transistor T9. Referring to FIG. 8, the EC7 line is further extended to be connected to the input electrode of the first transistor T1 and the gate electrode G2 of the second transistor T2 of the stage 150, that are disposed in the second column through the 15 line, and additionally further extended to the scan line S1 as shown FIG. 9 and FIG. 10.

A gate electrode G5 of the fifth transistor T5 is extended to form a GCK−1 line and is electrically connected to a GCK line. The GCK line extends in a longitudinal direction but has an EC8 line extending to the right. The EC8 line is electrically connected to the second electrode of the QB-node capacitor $C_{QB}$, and is further extended to form the input electrode of the ninth transistor T9.

A VGL line is extended to the left and is electrically connected to the input electrode of the fifth transistor T5.

As shown in FIG. 7, the height Y occupied by the stage 150 is reduced by reducing a space in which the fifth transistor T5 and the GCK line and the VGL line are connected. In other words, when the GCK−1 line passes the eighth transistor T8 and further extends, a space must be provided so that the GCK−1 line may pass the eighth transistor T8, and a vertical height of the stage is further increased for this purpose. However, in FIG. 7, the GCK line is disposed adjacent to the fifth transistor T5 to minimize the height occupied by the stage 150. This configuration also applies to the VGL line.

A structure of the ninth transistor T9 is substantially the same as that of the eighth transistor T8, and a structure of a unit ninth transistor T9 is substantially the same as that of a unit eighth transistor T8. However, instead of the EC4 line and the EC5 line of the eighth transistor T8, the EC7 line and the EC8 line are used in the ninth transistor T9. The EC7 line forms the output electrode of the ninth transistor T9, and the EC8 line forms the input electrode of the ninth transistor T9.

In the planar structures of the eighth transistor T8 and the ninth transistor T9, only a doping region is formed between the two gate electrodes G8 and G9 to reduce the height occupied by the transistor. This is because if the electrode is formed, its height will be increased. According to the dual gate structure, it also serves to reduce a leakage current in addition to the area (height reduction). Hereinafter, a structure having the lines EC4, EC5, EC7, and EC8 connecting unit transistors, like the eighth transistor T8 and the ninth transistor T9, is also referred to as a finger-type transistor.

Although the planar structures of the eighth transistor T8 and the ninth transistor T9 are different from the other transistors T1, T2, T3, T4, T5, T6, and T7, the cross-sectional structures thereof are similar to that of FIG. 11. The cross-sectional structures of the transistors will be described in detail below with reference to FIG. 11.

Meanwhile, the Q-node capacitor $C_Q$ and the QB-node capacitors $C_{QB}$ are shown in FIG. 7. The two capacitors include a first electrode formed of a first conductive layer and a second electrode formed of a second conductive layer, and cross-sectional structures thereof are substantially the same and are shown in FIG. 12. The structures of the two capacitors in FIG. 12 will be described below.

FIG. 8 is a view similar to FIG. 6, however, it illustrates in detail the stage 150 disposed in the second column, unlike FIG. 6. A stage disposed in the first column and a stage disposed in the second column have substantially the same internal structure, and only the line structures thereof to be connected are different. In other words, an I1' line of FIG. 8 corresponding to the I1 line of FIG. 6 is connected to the second clock line CLK2, a I2' line of FIG. 8 corresponding to the I2 line of FIG. 6 is connected to the third clock line CLK3, and an I3' line of FIG. 8 corresponding to the I3 line of FIG. 6 is connected to the fourth clock line CLK4.

In addition, a structure of FIG. 9 is similar to that of FIG. 7, e.g., there is no difference between them except for lines to be connected.

FIG. 10 shows from an end portion of the stage 150 EVEN disposed in the second column to a scan line connected thereto. Outputs of the stage 150 ODD of the first column shown in FIGS. 6 and 7 are connected to odd scan lines, and outputs of the stage 150 EVEN of the second column shown in FIG. 8 and FIG. 9 are connected to even scan lines. The scan lines receiving the scan signals extend to the display area 110 and are connected to the pixels 111.

FIG. 11 illustrates a structure of the fourth transistor T4 having a structure in which two gate electrodes are formed. The cross-sectional structures of the other transistors T1, T2, T3, T5, T6, T7, T8, and T9 are not significantly different from the fourth transistor T4, and thus they will be described with reference to FIG. 11. Different portions of respective transistors only differ in how doped semiconductor layers are connected to the remaining other portions.

Referring to FIG. 11, one transistor has a polycrystalline semiconductor layer formed on a substrate Sub, and the polycrystalline semiconductor layer includes doped portions (doped-1, doped-2, and doped-3) and non-doped portions C between them. The non-doped portion C is a portion where a channel is formed. The doped-portions (doped-1, doped-2, and doped-3) have properties similar to that of a conductor.

A first interlayer insulating film IL1 (also referred to as a gate insulating film) is disposed on the polycrystalline semiconductor layer. A gate electrode G is disposed on the first interlayer insulating film IL1. Two gate electrodes G are formed, and the two gate electrodes G correspond to the doped portion (doped-3).

Second to fourth interlayer insulating films IL2 and IL3, and IL4 covering the gate electrode G are disposed. Although four interlayer insulating films are shown in FIG. 11, one or two interlayer insulating films may be formed.

A third conductive layer is disposed on the fourth interlayer insulating film IL4, and they form an input electrode TE1 and an output electrode TE2, respectively. An opening is provided in the interlayer insulating films IL1, IL2, IL3, and IL4, so that the input electrode TE1 is electrically connected to the first doped portion (doped-1) of the semiconductor layer, and the output electrode TE2 is electrically connected to the second doped portion (doped-2) of the semiconductor layer.

When a gate-on voltage is applied to the gate electrode G, a voltage of the input electrode TE1 is transmitted to the first doped portion (doped-1), and the first doped portion (doped-1) having conductor characteristics transmits a voltage to the non-doped portion C of the semiconductor layer. Since a channel is formed in the non-doped portion C of the semiconductor layer, a voltage is transmitted to the third doped portion (doped-3) through the channel. Since the third doped portion (doped-3) also has conductor characteristics, a voltage passes it and is transmitted to the non-doped portion C adjacent thereto, passes through the channel formed in the non-doped portion C, and is outputted to the output electrode TE2 through the second doped portion (doped-2).

This transistor has a dual gate structure, and thus the leakage current is reduced. In addition, an input electrode and an output electrode, which may be additionally formed in the third doped portion (doped-3), may be omitted, and only the doped semiconductor layer may be formed to reduce the area occupied by the transistor. The same is applied to the eighth transistor T8 and the ninth transistor T9, and if an electrode is formed in a portion corresponding to the third doped portion (doped-3) exposed in the eighth transistor T8 and the ninth transistor T9, since the heights of the eighth transistor T8 and the ninth transistor T9 are higher in FIG. 7, the height Y of the stage 150 may also increase. However, the dual gate structure is used and the doped portion (the third doped portion (doped-3)) is formed in the middle to reduce the height Y of the stage 150 to correspond to twice the height P of the pixel 111.

Since the transistors formed in the stage 150 are formed through substantially the same process as the pixel circuit portion of the pixel 111 on the substrate 100, when the transistors included in the pixel 111 are n-type transistors, the transistors in the stage 150 are formed as n-type transistors, and when the transistors included in the pixel 111 are p-type transistors, the transistors in the stage 150 may be formed as p-type transistors. Here, in the case of an n-type transistor, a lightly doped region LDD may be further formed between the doped portion and the non-doped portion C. When a sidewall of the gate electrode G is inclined to have a tapered structure, if a doping process is performed with the gate electrode G as a mask, the lightly doped region LDD, which is disposed between the doped portion and the non-doped portion C, is formed under the tapered structure. Through this process, the lightly doped region LDD may be formed.

Meanwhile, a cross-sectional structure of two capacitors (the Q-node capacitor $C_Q$ and the QB-node capacitor $C_{QB}$) included in the stage 150 is shown in FIG. 12.

Referring to FIG. 12, in the capacitor, the first interlayer insulating film IL1 is disposed on the substrate Sub, and a first electrode CE1 is formed on the first interlayer insulating film IL1.

The second interlayer insulating film IL2 is disposed on the first electrode CE1, and the second electrode CE2 is disposed on the second interlayer insulating film IL2.

The third and fourth interlayer insulating films IL3 and IL4 covered the second electrode CE2. In exemplary embodiments of the inventive concept, only one interlayer insulating film may cover the second electrode CE2.

An SD electrode is formed on the fourth interlayer insulating film IL4, and is electrically connected to the second electrode CE2 through an opening formed in the fourth interlayer insulating film IL4.

The capacitor includes the first electrode CE1, the second electrode CE2, and the second interlayer insulating film IL2 disposed therebetween.

The cross-sectional structures of the transistors and the capacitors included in the scan driver have been described with reference to FIG. 11 and FIG. 12. Since the scan driver of the present exemplary embodiment is formed together with the pixel 111 on the substrate, the scan driver may be the same as or similar to the stacked structure of the transistor or the capacitor included in the pixel circuit portion supplying a current to the organic light emitting diode in the pixel 111. In exemplary embodiments of the inventive concept, the stacked structures may be different from each other. However, even if the stacked structures are different as described above, when the pixel circuit portion is formed using three conductive layers, the scan driver may also be formed using three conductive layers or fewer conductive layers.

FIG. 11 and FIG. 12 illustrate structures in which four interlayer insulating films are disposed between the conductive layers, and thus the pixel circuit portion may be formed using four conductive layers.

However, when three conductive layers are used in the pixel circuit portion, the fourth interlayer insulating film IL4 may be omitted in FIG. 11 and FIG. 12.

Hereinafter, a modified embodiment of the exemplary embodiment described above will be described.

First, an exemplary embodiment of the inventive concept including a dummy stage will be described with reference to FIG. 13.

Figure 13:
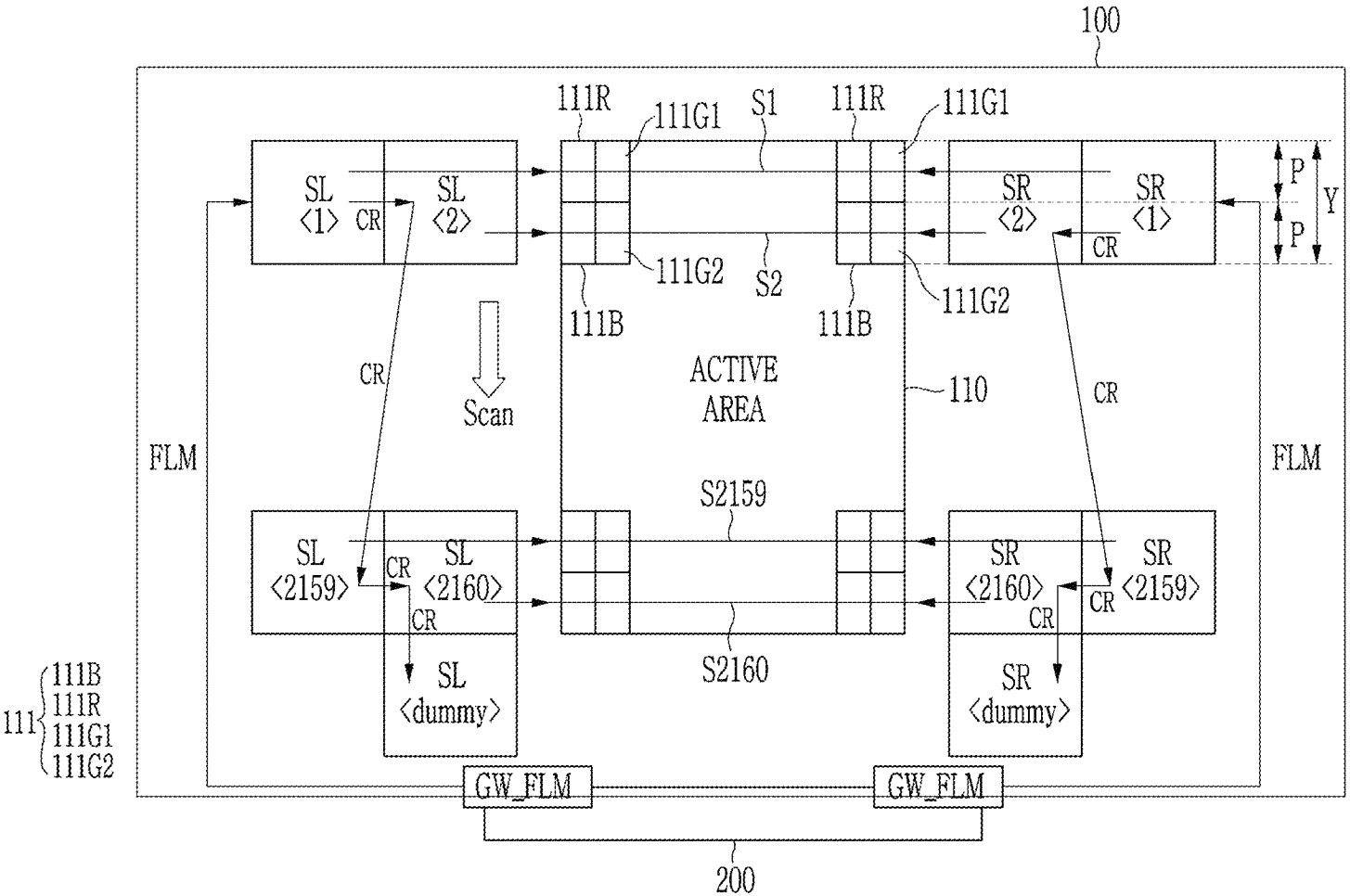
FIG. 13 illustrates a schematic diagram of a display device according to an exemplary embodiment of the inventive concept.

FIG. 13 illustrates a schematic diagram of a display device according to an exemplary embodiment of the inventive concept.

FIG. 13 differs from FIG. 1 in that FIG. 13 further includes a dummy stage (SL<dummy>). In addition, the four clock lines CLK1, CLK2, CLK3, and CLK4, the global clock signal line GCK, and the low voltage line VGL are not shown in FIG. 13, but a carry signal CR is shown in FIG. 13. Further, in FIG. 13, a start signal generator GW_FLM is further included in the signal controller 200.

The dummy stage (SL<dummy>) of FIG. 13 is formed after the last stage, and is formed in only one of two columns of stages. Thus, one dummy stage is included for every two columns. However, in exemplary embodiments of the inventive concept, more dummy stages may be further included, and the dummy stage may be formed in each of both columns. The dummy stage (SL<dummy>) of FIG. 13 serves to receive the carry signal CR, and since a line for applying the carry signal CR is not formed, the dummy stage (SL<dummy>) prevents the scan signal from being varied from the other scan lines while a value of a resistance connected to the last scan line (S2160 in FIG. 13) is changed.

In exemplary embodiments of the inventive concept, the dummy stage may be further included before the first stage. In such an exemplary embodiment, the carry signal CR may also be transmitted to this dummy stage.

FIG. 13 shows that the height Y of the stage is twice the height P of the pixel 111. Herein, the pixel 111 may refer to a pixel circuit portion including a transistor, a capacitor, and the like that are formed to operate the organic light emitting diode.

Hereinafter, an exemplary embodiment in which stages are arranged in three columns will be described with reference to FIG. 14.

Figure 14:
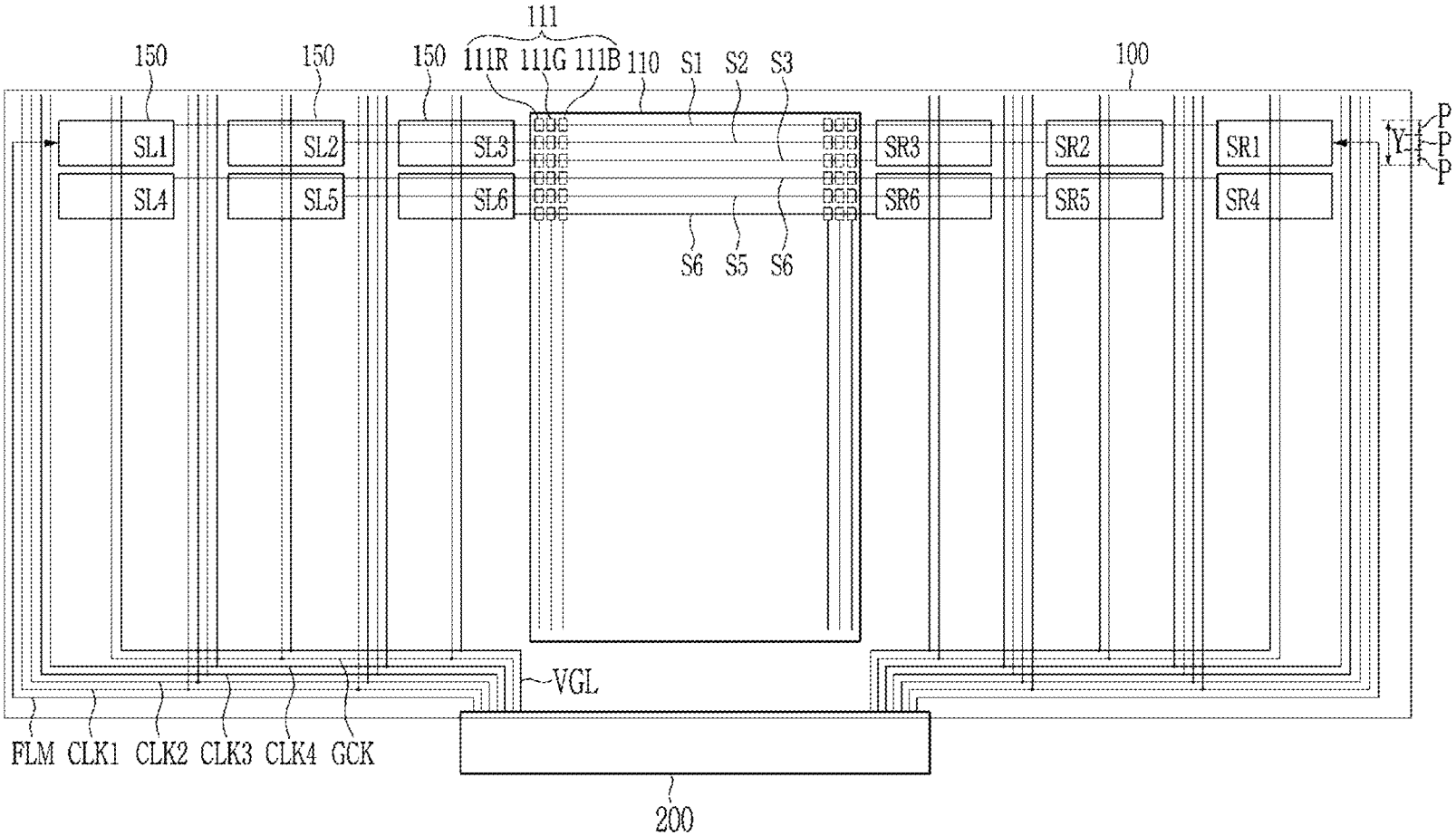
FIG. 14 illustrates a schematic diagram of a display device according to an exemplary embodiment of the inventive concept.

FIG. 14 illustrates a schematic diagram of a display device according to an exemplary embodiment of the inventive concept.

Unlike the exemplary embodiment of FIG. 1, the exemplary embodiment of FIG. 14 forms the stage 150 in three columns, and the height Y of the stage 150 is three times the height P of the pixel 111. In the exemplary embodiment of FIG. 14, when the height P of the pixel 111 is smaller than the height Y of the stage 150 because a size of the pixel is smaller than that of FIG. 1, the height Y of the stage 150 is adjusted to correspond to three times the height P of the pixel 111.

In addition, in the exemplary embodiment of FIG. 14, the pixel 111 is illustrated as including a red pixel 111R, a green pixel 111G, and a blue pixel 111B formed in a ratio of 1:1:1, unlike the exemplary embodiment of FIG. 1.

In the exemplary embodiment of FIG. 14, the global clock signal line GCK and the low voltage line VGL pass through the middle portion of the stage 150.

The connection between the four clock lines CLK1, CLK2, CLK3, and CLK4 and the stage 150 is substantially the same as the exemplary embodiments described above. In other words, when the first stage 150 (e.g., SL1) is connected to the first clock line CLK1, the second clock line CLK2, and the third clock line CLK3, the second stage 150 (e.g., SL2) is connected to the second clock line CLK2, the third clock line CLK3, and the fourth clock line CLK4, and the third stage 150 (e.g., SL3) is connected to the third clock line CLK3, the fourth clock line CLK4, and the first clock line CLK1. Then, the fourth stage 150 (e.g., SL4) of the first column of the stages disposed in the second row is connected to the fourth clock line CLK4, the first clock line CLK1, and the second clock line CLK2, and in this manner, the stages 150 and three of the four clock lines CLK1, CLK2, CLK3, and CLK4 are connected.

Hereinafter, an exemplary embodiment of forming a line FLM that is short for transmitting a start signal from the signal controller 200 to a first stage will be described with reference to FIG. 15.

Figure 15:
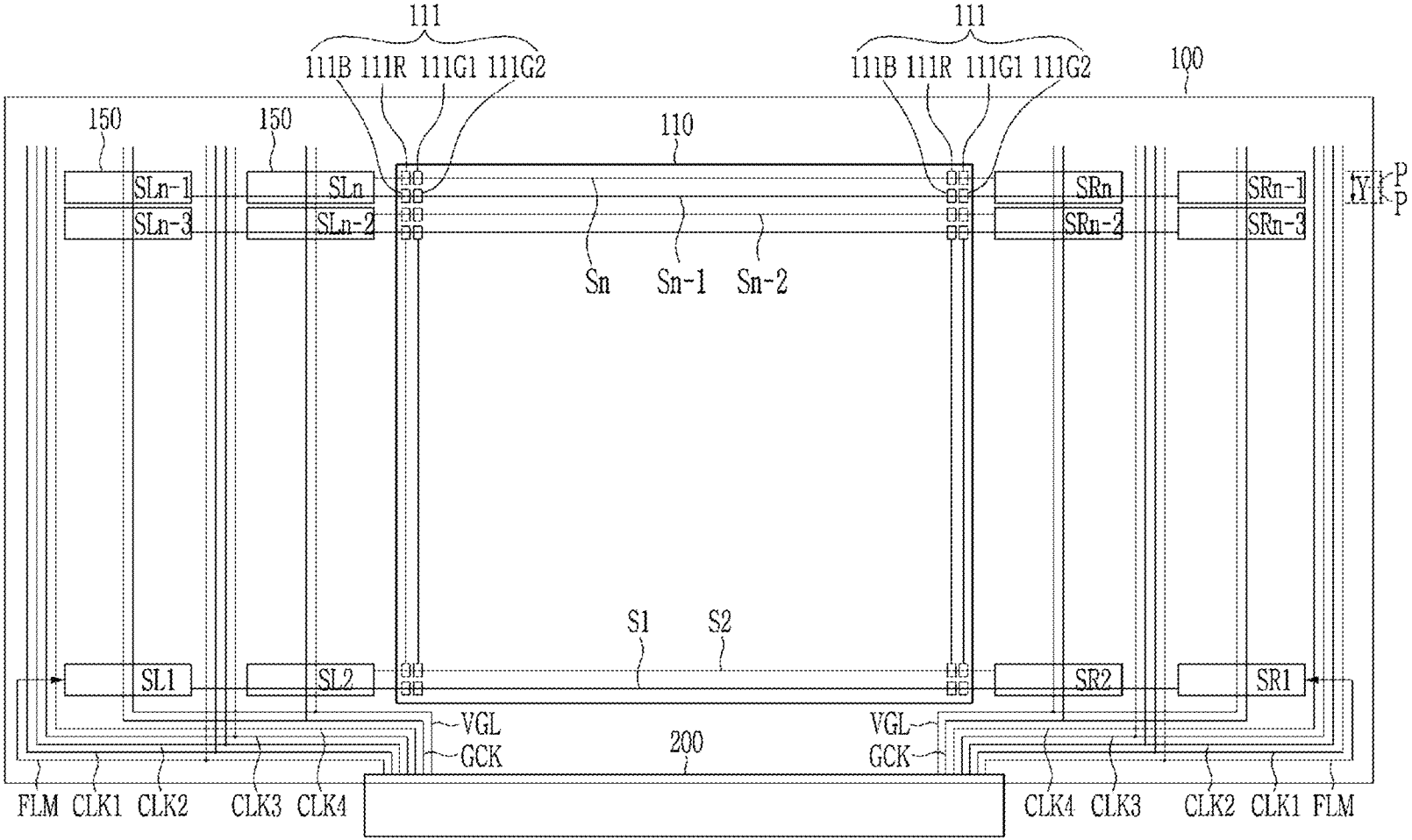
FIG. 15 illustrates a schematic diagram of a display device according to an exemplary embodiment of the inventive concept.

FIG. 15 illustrates a schematic diagram of a display device according to an exemplary embodiment of the inventive concept.

FIG. 15 corresponds to FIG. 1, but unlike FIG. 1, in FIG. 15, the line FLM for transmitting the start signal is connected to the stage 150 adjacent to the signal controller 200.

According to the exemplary embodiment as shown in FIG. 15, the start signal line FLM to be formed outside the four clock lines CLK1, CLK2, CLK3, and CLK4 may not be long.

In FIG. 15, unlike FIG. 1, high voltages of the scan signals are sequentially transmitted from bottom to top. This is because the first stage receiving the start signal is disposed at the bottom. In contrast, in the exemplary embodiment of FIG. 1, high voltages of the scan signals are sequentially transmitted from top to bottom.

FIG. 1 and FIG. 15 illustrate cases in which the signal controller 200 transmitting the start signal is disposed below the substrate 100, but in exemplary embodiments of the inventive concept, the signal controller 200 may be disposed above the substrate 100.

When the signal controller 200 is disposed above the substrate 100, a shorter start signal line FLM is formed when the stages 150 are formed in the same order as in FIG. 1.

According to exemplary embodiments of the inventive concept, since a high-resolution display device includes small pixels, the pixels are arranged in n columns while forming stages of a scan driver having a height corresponding to a height of n pixels (where n is an integer of 2 or more). Thus, it is possible to appropriately form the stages even in the display device having small pixels. In addition, by forming a signal line or a voltage line to cross a stage, it is possible to shorten a length of the line in the stage and thus to reduce a height occupied by the stage. Further, by forming a transistor included in a stage to have a dual gate structure, it is possible to reduce a leakage current and reduce a height occupied by the stage.

While the inventive concept has been shown and described with reference to exemplary embodiments thereof, it is to be understood by those of ordinary skill in the art that various modifications in form and details may be made thereto without departing from the spirit and scope of the inventive concept as set forth by the appended claims.

What is claimed is:

1. A display device comprising:

a substrate that includes a display area for displaying an image and a non-display area surrounding the display area;

a plurality of pixels that are disposed in the display area and each include an organic light emitting diode and a pixel circuit portion configured to operate the organic light emitting diode;

a plurality of scan lines that are disposed in the display area and electrically connected to the plurality of pixels;

a scan driver that is disposed in the non-display area and includes a plurality of stages configured to output scan signals to the plurality of scan lines, the plurality of stages comprising first stages arranged in a first direction; and lines disposed in the non-display area and configured to apply a control signal including a clock signal and including a first line, and lines configured to apply a voltage used in the scan driver and including a second line, wherein each of the plurality of stages comprises a plurality of transistors including at least a first transistor and a second transistor, and wherein at least one of the first line or the second line passes between the first transistor and the second transistor involved in each of the first stages, is elongated along the first direction, and continuously extends with a length longer than a height of each of the first stages in the first direction.

2. The display device of claim 1, wherein the plurality of stages are arranged in n columns, a height of one stage corresponds to a height of n pixels, and n is an integer of 2 or more.

3. The display device of claim 1, wherein the lines configured to apply the control signal including the clock signal include four clock lines, and the first line comprises a global clock signal line, and the second line comprises a low voltage line.

4. The display device of claim 3, wherein the global clock signal line passes between the first transistor and the second transistor involved in one of the plurality of stages, and the low voltage line passes between the first transistor and the second transistor involved in one of the plurality of stages.

5. The display device of claim 3, wherein the four clock lines, the global clock signal line, and the low voltage line are formed in each of the plurality of stages.

6. The display device of claim 5, wherein the four clock lines are disposed farthest from the display area at an outer edge of the non-display area or between adjacent columns.

7. The display device of claim 5, further comprising a signal controller configured to provide a clock signal, a global clock signal, and a low voltage to the four clock lines, the global clock signal line, and the low voltage line, respectively.

8. The display device of claim 7, further comprising:

a test line configured to test the display device and disposed on the substrate, and a driving low voltage line configured to apply a driving low voltage to the plurality of pixels, wherein the test line and the driving low voltage line are disposed farther from the display area than the four clock lines.

9. The display device of claim 7, wherein each of the plurality of stages includes three clock input terminals, a global clock signal input terminal, a low voltage input terminal, a start signal input terminal, and an output terminal.

10. The display device of claim 9, wherein each of the plurality of stages further comprises:

two buffer transistors connected to the output terminal configured to output one of the scan signals, wherein each of the two buffer transistors comprises a plurality of a unit transistors connected to each other.

11. The display device of claim 9, wherein the start signal input terminal receives an output of a previous stage.

12. The display device of claim 11, wherein the plurality of stages further include a dummy stage configured to receive an output of a last stage.

13. The display device of claim 1, wherein in the plurality of pixels, a red pixel configured to display a red color, a blue pixel configured to display a blue color, and two green pixels configured to display a green color, in one unit, are repeatedly formed.

14. The display device of claim 1, wherein the plurality of pixels include a red pixel configured to display a red color, a blue pixel configured to display a blue color, and a green pixel configured to display a green color, and the red pixel, the blue pixel, and the green pixel are formed in a ratio of 1:1:1.

15. The display device of claim 1, wherein the plurality of stages are disposed at opposite sides of the display area, and two stages of the plurality of stages are connected to one scan line, and the two stages apply a same scan signal to the one scan line.

16. The display device of claim 1, wherein some of the lines configured to apply the control signal including the clock signal pass around each plurality of transistors involved in one of the plurality of stages.

17. A display device comprising:

a substrate that includes a display area for displaying an image and a non-display area surrounding the display area;

a plurality of pixels that are disposed in the display area and each include an organic light emitting diode and a pixel circuit portion configured to operate the organic light emitting diode;

a scan driver that is disposed in the non-display area and includes a plurality of stages configured to output scan signals to the plurality of pixels; and a signal controller configured to provide a clock signal, a global clock signal, and a low voltage, wherein each of the plurality of stages has a single output terminal, wherein the plurality of stages are arranged in n columns, a height of one stage corresponds to a height of n pixels, and n is an integer of 2 or more, wherein the substrate further includes lines that are disposed in the non-display area and configured to apply a control signal including a clock signal, and lines configured to apply a voltage used in the scan driver, and one of the lines configured to apply the control signal including the clock signal or one of the lines configured to apply the voltage used in the scan driver crosses at least one of the plurality of stages, wherein the lines configured to apply the control signal including the clock signal include four clock lines and a global clock signal line, and the lines configured to apply the voltage used in the scan driver include a low voltage line, wherein the four clock lines, the global clock signal line, and the low voltage line are formed in each of the plurality of stages, wherein the signal controller is configured to provide the clock signal, the global clock signal, and the low voltage to the four clock lines, the global clock signal line, and the low voltage line, respectively, wherein each of the plurality of stages includes three clock input terminals, a global clock signal input terminal, a low voltage input terminal, a start signal input terminal, and the single output terminal, and wherein each of the plurality of stages is connected to three of the four clock lines, a first stage of a first column disposed in a first row is connected to a first clock line, a second clock line, and a third clock line, a second stage of a second column disposed in the first row is connected to the second clock line, the third clock line, and a fourth clock line, a third stage of the first column disposed in a second row is connected to the third clock line, the fourth clock line, and the first clock line, and a fourth stage of the second column disposed in the second row is connected to the fourth clock line, the first clock line, and the second clock line.

18. A display device comprising:

a substrate that includes a display area for displaying an image and a non-display area surrounding the display area;

a plurality of pixels that are disposed in the display area and each include an organic light emitting diode and a pixel circuit portion configured to operate the organic light emitting diode;

a plurality of scan lines that are disposed in the display area and electrically connected to the plurality of pixels;

a scan driver that is disposed in the non-display area and includes a plurality of stages comprising first stages arranged in a first direction, wherein each of the plurality of stages comprises a plurality of transistors including at least a first transistor and a second transistor and is configured to output scan signals to the plurality of scan lines; and a signal controller configured to apply a control signal including a clock signal and a voltage used in the scan driver to the scan driver, wherein a line that applies the control signal including the clock signal or the voltage used in the scan driver passes between the first transistor and the second transistor involved in each of the first stages, is elongated along the first direction, and continuously extends with a length longer than a height of each of the first stages in the first direction.

19. The display device of claim 18, wherein in the non-display area of the substrate, four clock lines, a global clock signal line, and a low voltage line connect the signal controller and the plurality of stages, the global clock signal line passing between the first transistor and the second transistor involved in one of the plurality of stages, the low voltage line passing between the first transistor and the second transistor involved in one of the plurality of stages, and the four clock lines pass around each plurality of transistors involved in one of the plurality of stages.

20. The display device of claim 18, wherein each of the plurality of stages includes:

an output terminal connected to a scan line configured to transmit a scan signal to the pixel circuit portion, and two buffer transistors connected to the output terminal, wherein the line passing between the first transistor and the second transistor involved in one of the plurality of stages passes between the two buffer transistors.

21. The display device of claim 18, wherein the plurality of stages included in the scan driver are arranged in n columns, and n is an integer of 2 or more.

22. A display device comprising:

a substrate that includes a display area for displaying an image and a non-display area surrounding the display area;

a plurality of pixels that are disposed in the display area;

a plurality of scan lines that are disposed in the display area and electrically connected to the plurality of pixels;

a scan driver that is disposed in the non-display area and includes a plurality of stages comprising first stages arranged in a first direction, wherein each of the plurality of stages comprises a plurality of transistors including at least a first transistor and a second transistor and is configured to output scan signals to the plurality of scan lines;

four clock lines disposed adjacent to the plurality of stages;

a global clock signal line passing between the first transistor and the second transistor involved in each of the first stages; and a low voltage line passing between the first transistor and the second transistor involved in each of the first stages, wherein each of the plurality of stages is connected to only three of the four clock lines, and wherein at least one of the global clock signal line or the low voltage line is elongated along the first direction, and continuously extends with a length longer than a height of each of the first stages in the first direction.

23. The display device of claim 22, wherein the four clock lines disposed adjacent to the plurality of stages pass around each plurality of transistors involved in one of the plurality of stages.

* * * * *